US008820972B2

(12) United States Patent
Mollnow et al.

(10) Patent No.: US 8,820,972 B2
(45) Date of Patent: Sep. 2, 2014

(54) LED-BASED LUMINAIRES FOR LARGE-SCALE ARCHITECTURAL ILLUMINATION

(75) Inventors: Tomas Mollnow, Somerville, MA (US); Ryan Williamson, Somerville, MA (US); Steven Kondo, Quincy, MA (US); Eric Roth, Rockport, MA (US); Ihor Lys, Milton, MA (US)

(73) Assignee: Koninklijke Philips N.V., Eindhoven (NL)

( * ) Notice: Subject to any disclaimer, the term of this patent is extended or adjusted under 35 U.S.C. 154(b) by 646 days.

(21) Appl. No.: 12/808,910

(22) PCT Filed: Dec. 22, 2008

(86) PCT No.: PCT/IB2008/055497

§ 371 (c)(1),
(2), (4) Date: Nov. 8, 2010

(87) PCT Pub. No.: WO2009/081382

PCT Pub. Date: Jul. 2, 2009

(65) Prior Publication Data

US 2011/0285292 A1 Nov. 24, 2011

Related U.S. Application Data

(60) Provisional application No. 61/016,447, filed on Dec. 22, 2007.

(51) Int. Cl.

| | |
|---|---|
| ***F21S 10/02*** | (2006.01) |
| ***F21V 29/00*** | (2006.01) |
| *F21Y 113/00* | (2006.01) |
| *F21S 2/00* | (2006.01) |
| *F21W 131/107* | (2006.01) |
| *F21V 21/30* | (2006.01) |
| *F21Y 101/02* | (2006.01) |
| *F21Y 105/00* | (2006.01) |

(52) U.S. Cl.

CPC ..... *F21V 29/004* (2013.01); *F21Y 2113/005* (2013.01); *F21S 10/02* (2013.01); *F21V 29/2293* (2013.01); *F21S 2/005* (2013.01); *F21W 2131/107* (2013.01); *F21V 29/265* (2013.01); *F21V 21/30* (2013.01); *F21Y 2101/02* (2013.01); *F21Y 2105/001* (2013.01); *F21V 29/225* (2013.01)

USPC ..... 362/294; 362/228

(58) Field of Classification Search

None

See application file for complete search history.

(56) References Cited

U.S. PATENT DOCUMENTS 6,016,038 A * 1/2000 Mueller et al. ..... 315/291
6,211,626 B1 4/2001 Lys et al.

(Continued)

FOREIGN PATENT DOCUMENTS

WO 8804875 A 6/1988

*Primary Examiner* — Diane Lee
*Assistant Examiner* — Gerald J Sufleta, II
(74) *Attorney, Agent, or Firm* — Yuliya Mathis

(57) ABSTRACT

Disclosed herein are exterior architectural fixtures employing LED-based light sources that are capable of projecting light over long distances and providing a wide variety of lighting effects with high lumen output. These lighting fixtures have improved heat dissipation properties and are particularly suitable for large-scale façade washing and for illuminating large architectural structures, such as skyscrapers, casinos, and retail establishments, integrating efficient and compact power supply and control components for driving high-intensity LEDs to achieve a vast variety of lighting effects on a large scale.

19 Claims, 16 Drawing Sheets

(56) References Cited

U.S. PATENT DOCUMENTS

| | | | | |
|---|---|---|---|---|
| 6,548,967 | B1 * | 4/2003 | Dowling et al. | 315/318 |
| 2003/0028260 | A1 | 2/2003 | Blackwell | |
| 2003/0193816 | A1 | 10/2003 | Rahn | |
| 2005/0231948 | A1 | 10/2005 | Pohlert | |
| 2005/0265024 | A1 | 12/2005 | Luk | |
| 2006/0262545 | A1 * | 11/2006 | Piepgras et al. | 362/373 |
| 2007/0230184 | A1 * | 10/2007 | Shuy | 362/294 |
| 2007/0273798 | A1 * | 11/2007 | Silverstein et al. | 348/752 |
| 2008/0101064 | A1 * | 5/2008 | Draganov et al. | 362/231 |
| 2008/0130304 | A1 * | 6/2008 | Rash et al. | 362/477 |

* cited by examiner

LED-BASED LUMINAIRES FOR LARGE-SCALE ARCHITECTURAL ILLUMINATION

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626.

In particular, luminaires employing high-flux LEDs are fast emerging as a superior alternative to conventional light fixtures because of their higher overall luminous efficacy and ability to generate various lighting patterns and effects. One significant concern in the design and operation of these luminaires is thermal management, because the LEDs perform at a higher efficacy and last longer when run at cooler temperatures. High-flux LEDs tend to be particularly sensitive to operating temperatures, as the efficiency of dissipating heat generated by these LEDs significantly correlates to the operating life, performance, and reliability of the LED light source. Thus, maintaining optimal junction temperature is an important consideration in developing a high-performance lighting system. Efficient heat dissipation, however, may present a challenge when the size of the fixture and the density and flux of the LED light sources increase. Also of concern for larger fixtures, such as those used for exterior applications, are safety of handling and installation as well as ruggedness.

One desirable application for LED-based luminaires, particularly those employing high-flux LEDs, is illumination of large architectural surfaces and objects, concentrating light in a specific direction. Conventional projection fixtures have been used for this purpose for many years in various theatrical, television, architectural and general illumination applications (e.g., overhead projection, spotlight illumination, illumination of airport runways and high-rise buildings, etc.). Typically, these fixtures include an incandescent or a gas-discharge lamp mounted adjacent to a concave reflector, which reflects light through a lens assembly to project a narrow beam of light over considerable distance towards a target object.

In recent years, LED-based lighting fixtures also have been used in some types of projection lighting fixtures, configured as luminaires for interior or exterior applications to improve definition of three-dimensional objects, as well as provide spotlight illumination or wall-washing lighting effects for architectural surfaces. In particular, surface mount or chip-on-board assemblies of single or multiple LEDs have attracted attention in the industry for use in applications requiring high luminance combined with narrow-beam light generation (to provide tight focusing/low geometric spreading of illumination). A "chip-on-board" (COB) LED assembly refers generally to one or more semiconductor chips (or "dies") in which one or more LED junctions are fabricated, wherein the chip(s) is/are mounted (e.g., adhered) directly to a printed circuit board (PCB). The chip(s) is/are then wire bonded to the PCB, after which a glob of epoxy or plastic may be used to cover the chip(s) and wire connections. One or more such LED assemblies, or "LED packages," in turn may be mounted to a common mounting board or substrate of a lighting fixture.

For some narrow-beam applications involving LED chips or dies, optical elements may be used together with the LED chip-on-board assembly to facilitate focusing of the generated light to create a narrow-beam of collimated or quasi-collimated light. Optical structures for collimating visible light, often referred to as "collimator lenses" or "collimators," are known in the art. These structures capture and redirect light emitted by a light source to improve its directionality. One such collimator is a total internal reflection ("TIR") collimator. A TIR collimator includes a reflective inner surface that is positioned to capture much of the light emitted by a light source subtended by the collimator. The reflective surface of conventional TIR collimators is typically conical, that is, derived from a parabolic, elliptical, or hyperbolic curve.

Thus, there exists a need in the art for a high-performance LED-based luminaire with improved light extraction and heat dissipation properties. Particularly desirable is an LED-based narrow-beam luminaire suitable for large scale lighting applications, such as spotlight illumination of large objects and structures or wall-washing lighting effects for exterior architectural surfaces.

SUMMARY

In its various embodiments and implementations, the invention disclosed herein generally relates to exterior architectural fixtures employing LED-based light sources that are capable of projecting light over long distances and providing a wide variety of lighting effects with high lumen output. More particularly, this invention is directed to architectural lighting fixtures suitable for large-scale facade washing and for illuminating larger architectural structures, such as skyscrapers, casinos, and retail establishments.

In various implementations, an architectural luminaire or lighting fixture includes at least two LED-based lighting units, each lighting unit including multiple LED-based light sources. In one exemplary implementation, each lighting unit includes a large number of LED sources in the form of "LED packages" or chip-on-board assemblies, which may be configured to generate any of variety of radiation spectrums. The lighting units of the luminaire are configured so as to form a "split housing" structure with air gaps between the lighting units to facilitate heat dissipation, and each lighting unit is equipped with heat-dissipating fins to further facilitate heat dissipation. In another aspect, the fixture may include power supply and control circuitry disposed in a separate controller housing coupled to the split fixture housing so as to allow air gaps between the control housing and the split fixture housing.

In yet other aspects, an architectural luminaire according to various embodiments of the present invention further may include a plurality of split reflector optics for collimating the light generated by the LED packages of each lighting unit into a narrow beam having, for example, about a 5-degree beam angle. In various implementations, each reflector optic has top and bottom portions that define a unitary reflective surface. The maximum diameter of the top portion is greater than or equal to the maximum diameter of the bottom portion, including a mounting foot thereof, to permit a densely-packed configuration of reflector optics.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like.

In particular, the term LED refers to light emitting diodes of all types (including semiconductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources, fluorescent sources, phosphorescent sources, high-intensity discharge sources (e.g., sodium vapor, mercury vapor, and metal halide lamps), and other sources. A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination.

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that terminology explicitly employed herein that also may appear in any disclosure incorporated by reference below should be accorded a meaning most consistent with the particular inventive concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the technology disclosed herein and related inventive concepts.

DETAILED DESCRIPTION

Various embodiments and implementations of the present invention are described below, including certain implementations relating to projection lighting, particularly spotlight illumination of large objects and structures and wall-washing of architectural surfaces. It should be appreciated, however, that the present disclosure is not limited to any particular manner of implementation, and that the various embodiments discussed explicitly herein are primarily for purposes of illustration. For example, the various concepts discussed herein may be suitably implemented in a variety of fixtures having different form factors and light output and suitable for interior and/or exterior illumination.

Figure 1:
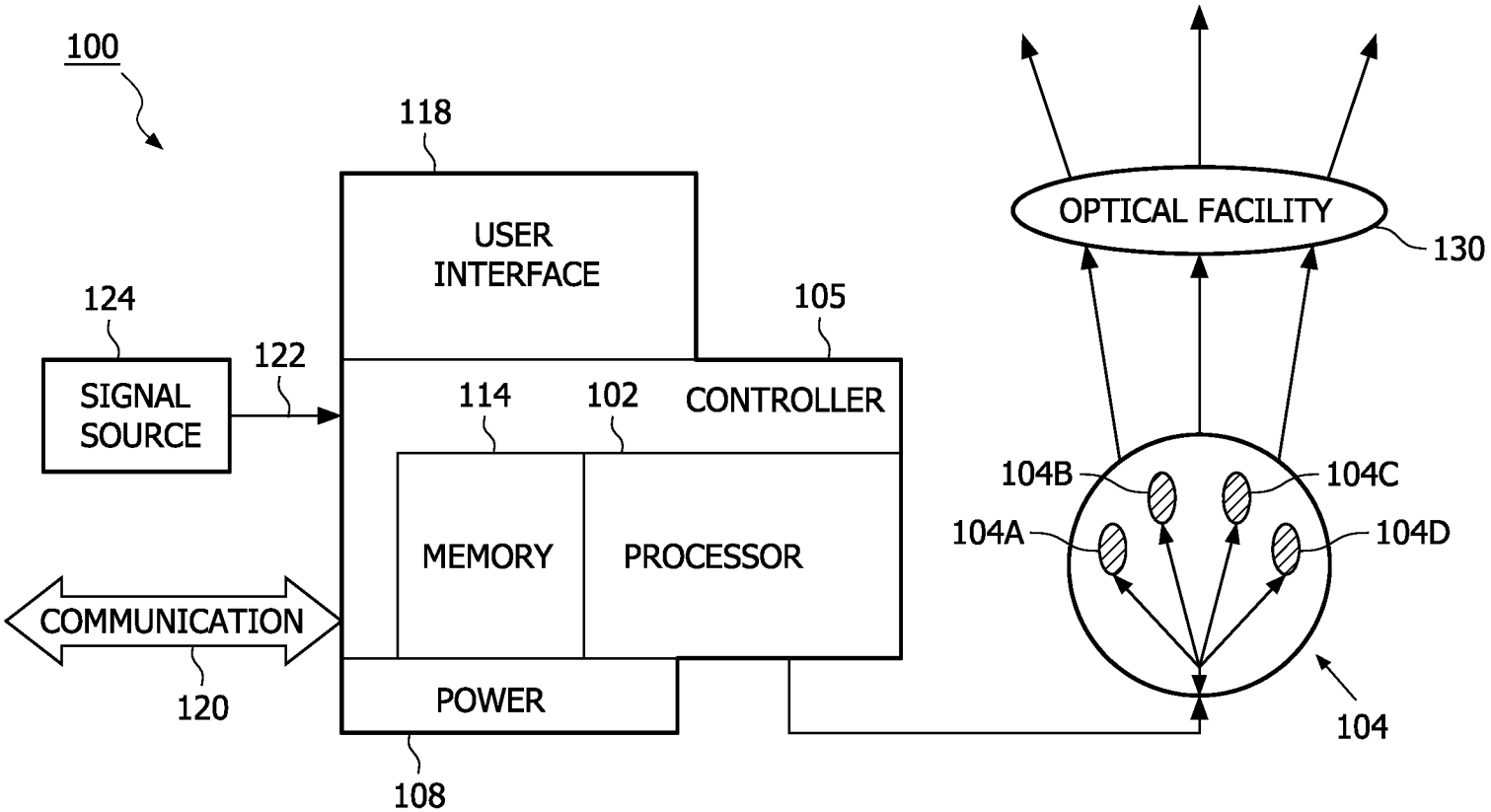
FIG. 1 is a diagram illustrating a controllable LED-based lighting unit suitable for use with an architectural luminaire disclosed herein.

Generally, in some aspects, the present invention relates to high-output lighting systems capable of projecting a narrow beam of light over considerable distance towards a target object and suitable for illumination of large architectural structures, such as buildings and bridges. These "far-throw" lighting systems integrate efficient and compact power supply and control components for driving high-intensity LEDs to achieve a vast variety of lighting effects on a large scale. FIG. 1 illustrates one example of a lighting unit 100 suitable for use with the lighting systems according to many implementations of the present disclosure. Some general examples of LED-based lighting units similar to those that are described below in connection with FIG. 1 may be found, for example, in U.S. Pat. No. 6,016,038, issued Jan. 18, 2000, entitled "Multicolored LED Lighting Method and Apparatus," and U.S. Pat. No. 6,211,626, issued Apr. 3, 2001, entitled "Illumination Components." In various embodiments, the lighting unit 100 shown in FIG. 1 may be used alone or together with other similar lighting units in a system of lighting units (e.g., as discussed further below in connection with FIG. 2).

Referring to FIG. 1, in many embodiments, the lighting unit 100 includes one or more light sources 104A, 104B, 104C, and 104D (shown collectively as 104), wherein one or more of the light sources may be an LED-based light source that includes one or more LEDs. Any two or more of the light sources may be adapted to generate radiation of different colors (e.g. red, green, blue); in this respect, as discussed above, each of the different color light sources generates a different source spectrum that constitutes a different "channel" of a "multi-channel" lighting unit. Although FIG. 1 illustrates four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As further illustrated in FIG. 1, the lighting unit 100 also may include a controller 105 that is configured to output one or more control signals to drive the light sources so as to generate various intensities of light from the light sources. For example, in one implementation, the controller may be configured to output at least one control signal for each light source so as to independently control the intensity of light (e.g., radiant power in lumens) generated by each light source; alternatively, the controller may be configured to output one or more control signals to collectively control a group of two or more light sources identically. Some examples of control signals that may be generated by the controller to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In one aspect, particularly in connection with LED-based sources, one or more modulation techniques provide for variable control using a fixed current level applied to one or more LEDs, so as to mitigate potential undesirable or unpredictable variations in LED output that may arise if a variable LED drive current were employed. In another aspect, the controller 105 may control other dedicated circuitry (not shown in FIG. 1) which in turn controls the light sources so as to vary their respective intensities.

In general, the intensity (radiant output power) of radiation generated by the one or more light sources is proportional to the average power delivered to the light source(s) over a given time period. Accordingly, one technique for varying the intensity of radiation generated by the one or more light sources involves modulating the power delivered to (i.e., the operating power of) the light source(s). For some types of light sources, including LED-based sources, this may be accomplished effectively using a pulse width modulation (PWM) technique.

In one exemplary implementation of a PWM control technique, for each channel of a lighting unit a fixed predetermined voltage $V_{source}$ is applied periodically across a given light source constituting the channel. The application of the voltage $V_{source}$ may be accomplished via one or more switches (not shown) controlled by the controller 105. While the voltage $V_{source}$ is applied across the light source, a predetermined fixed current $I_{source}$ (e.g., determined by a current regulator, also not shown in FIG. 1) is allowed to flow through the light source. Again, recall that an LED-based light source may include one or more LEDs, such that the voltage $V_{source}$ may be applied to a group of LEDs constituting the source, and the current $I_{source}$ may be drawn by the group of LEDs. The fixed voltage $V_{source}$ across the light source when energized, and the regulated current $I_{source}$ drawn by the light source when energized, determines the amount of instantaneous operating power $P_{source}$ of the light source ($P_{source}=V_{source}\cdot I_{source}$). As mentioned above, for LED-based light sources, using a regulated current mitigates potential undesirable or unpredictable variations in LED output that may arise if a variable LED drive current were employed.

According to the PWM technique, by periodically applying the voltage Vsource to the light source and varying the time the voltage is applied during a given on-off cycle, the average power delivered to the light source over time (the average operating power) may be modulated. In particular, the controller 105 may be configured to apply the voltage Vsource to a given light source in a pulsed fashion (e.g., by outputting a control signal that operates one or more switches to apply the voltage to the light source), preferably at a frequency that is greater than that capable of being detected by the human eye (e.g., greater than approximately 100 Hz). In this manner, an observer of the light generated by the light source does not perceive the discrete on-off cycles (commonly referred to as a "flicker effect"), but instead the integrating function of the eye perceives essentially continuous light generation. By adjusting the pulse width (i.e. on-time, or "duty cycle") of on-off cycles of the control signal, the controller varies the average amount of time the light source is energized in any given time period, and hence varies the average operating power of the light source. In this manner, the perceived brightness of the generated light from each channel in turn may be varied.

As discussed in greater detail below, the controller 105 may be configured to control each different light source channel of a multi-channel lighting unit at a predetermined average operating power to provide a corresponding radiant output power for the light generated by each channel. Alternatively, the controller may receive instructions (e.g., "lighting commands") from a variety of origins, such as a user interface 118, a signal source 124, or one or more communication ports 120, that specify prescribed operating powers for one or more channels and, hence, corresponding radiant output powers for the light generated by the respective channels. By varying the prescribed operating powers for one or more channels (e.g., pursuant to different instructions or lighting commands), different perceived colors and brightness levels of light may be generated by the lighting unit.

In one embodiment of the lighting unit 100, as mentioned above, one or more of the light sources 104A, 104B, 104C, and 104D shown in FIG. 1 may include a group of multiple LEDs or other types of light sources (e.g., various parallel and/or serial connections of LEDs or other types of light sources) that are controlled together by the controller 105. Additionally, it should be appreciated that one or more of the light sources may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit.

The lighting unit 100 may be constructed and arranged to produce a wide range of variable color radiation. For example, in various implementations, the lighting unit may be particularly arranged such that controllable variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals output by the controller 105). Furthermore, the controller may be particularly configured to provide control signals to one or more of the light sources so as to generate a variety of static or time-varying (dynamic) multi-color (or multi-color temperature) lighting effects. To this end, in one embodiment, the controller may include a processor 102 (e.g., a microprocessor) programmed to provide such control signals to one or more of the light sources. The processor may be programmed to provide such control signals autonomously, in response to lighting commands, or in response to various user or signal inputs.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Additionally, multiple white LEDs having different color temperatures (e.g., one or more first white LEDs that generate a first spectrum corresponding to a first color temperature, and one or more second white LEDs that generate a second spectrum corresponding to a second color temperature different than the first color temperature) may be employed, in an all-white LED lighting unit or in combination with other colors of LEDs. Such combinations of differently colored LEDs and/or different color temperature white LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

As shown in FIG. 1, the lighting unit 100 also may include a memory 114 to store various data. For example, the memory may be employed to store one or more lighting commands or programs for execution by the processor 102 (e.g., to generate one or more control signals for the light sources), as well as various types of data useful for generating variable color radiation (e.g., calibration information, discussed further below). The memory also may store one or more particular identifiers (e.g., a serial number, an address, etc.) that may be used either locally or on a system level to identify the lighting unit. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

In another aspect, as also shown in FIG. 1, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). The communication between the user interface and the lighting unit may be accomplished through wire or cable, or wireless transmission.

In various embodiments, the controller 105 of the lighting unit monitors the user interface 118 and controls one or more of the light sources 104A, 104B, 104C and 104D based at least in part on a user's operation of the interface. For example, the controller may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the controller 105. In one aspect of this implementation, the controller is configured to monitor the power as controlled by the user interface, and in turn control one or more of the light sources based at least in part on a duration of a power interruption caused by operation of the user interface. As discussed above, the controller may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

The lighting unit 100 may be configured to receive one or more signals 122 from one or more other signal sources 124. In one implementation, the controller 105 of the lighting unit may use the signal(s) 122, either alone or in combination with other control signals (e.g., signals generated by executing a lighting program, one or more outputs from a user interface, etc.), so as to control one or more of the light sources 104A, 104B, 104C and 104D in a manner similar to that discussed above in connection with the user interface. Examples of the signal(s) that may be received and processed by the controller 105 include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 124 may be located remotely from the lighting unit 100, or included as a component of the lighting unit. In one embodiment, a signal from one lighting unit could be sent over a network to another lighting unit.

Still referring to FIG. 1, the lighting unit may include one or more optical elements 130 to optically process the radiation generated by the light sources 104A, 104B, 104C, and 104D. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

The lighting unit 100 may include one or more communication ports 120 to facilitate coupling of the lighting unit to any of a variety of other devices. For example, one or more communication ports may facilitate coupling multiple lighting units together as a networked lighting system, in which at least some of the lighting units are addressable (e.g., have particular identifiers or addresses) and are responsive to particular data transported across the network.

In particular, in a networked lighting system environment, as discussed in greater detail further below (e.g., in connection with FIG. 2), as data is communicated via the network, the controller 105 of each lighting unit coupled to the network may be configured to be responsive to particular data (e.g., lighting control commands) that pertain to it (e.g., in some cases, as dictated by the respective identifiers of the networked lighting units). Once a given controller identifies particular data intended for it, it may read the data and, for example, change the lighting conditions produced by its light sources according to the received data (e.g., by generating appropriate control signals to the light sources). In one aspect, the memory 114 of each lighting unit coupled to the network may be loaded, for example, with a table of lighting control signals that correspond with data the processor 102 of the controller receives. Once the processor receives data from the network, the processor may consult the table to select the control signals that correspond to the received data, and control the light sources of the lighting unit accordingly.

In one aspect of this embodiment, the processor 102 of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. For example, in one aspect, considering for the moment a lighting unit based on red, green and blue LEDs (i.e., an "R-G-B" lighting unit), a lighting command in DMX protocol may specify each of a red channel command, a green channel command, and a blue channel command as eight-bit data (i.e., a data byte) representing a value from 0 to 255. The maximum value of 255 for any one of the color channels instructs the processor to control the corresponding light source(s) to operate at maximum available power (i.e., 100%) for the channel, thereby generating the maximum available radiant power for that color (such a command structure for an R-G-B lighting unit commonly is referred to as 24-bit color control). Hence, a command of the format [R, G, B]=[255, 255, 255] would cause the lighting unit to generate maximum radiant power for each of red, green and blue light (thereby creating white light).

It should be appreciated, however, that lighting units suitable for purposes of the present disclosure are not limited to a DMX command format, as lighting units according to various embodiments may be configured to be responsive to other types of communication protocols/lighting command formats so as to control their respective light sources. In general, the processor 102 may be configured to respond to lighting commands in a variety of formats that express prescribed operating powers for each different channel of a multi-channel lighting unit according to some scale representing zero to maximum available operating power for each channel.

The lighting unit 100 may include and/or be coupled to one or more power sources 108. In various aspects, examples of power source(s) include, but are not limited to, AC power sources, DC power sources, batteries, solar-based power sources, thermoelectric or mechanical-based power sources and the like. Additionally, in one aspect, the power source(s) may include or be associated with one or more power conversion devices that convert power received by an external power source to a form suitable for operation of the lighting unit.

A given lighting unit also may have any one of a variety of mounting arrangements for the light source(s), enclosure/housing arrangements and shapes to partially or fully enclose the light sources, and/or electrical and mechanical connection configurations. In particular, in some implementations, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.).

Additionally, one or more optical elements as discussed above may be partially or fully integrated with an enclosure/housing arrangement for the lighting unit. Furthermore, the various components of the lighting unit discussed above (e.g., processor, memory, power, user interface, etc.), as well as other components that may be associated with the lighting unit in different implementations (e.g., sensors/transducers, other components to faciliate communication to and from the unit, etc.) may be packaged in a variety of ways; for example, in one aspect, any subset or all of the various lighting unit components, as well as other components that may be associated with the lighting unit, may be packaged together. In another aspect, packaged subsets of components may be coupled together electrically and/or mechanically in a variety of manners.

Figure 2:
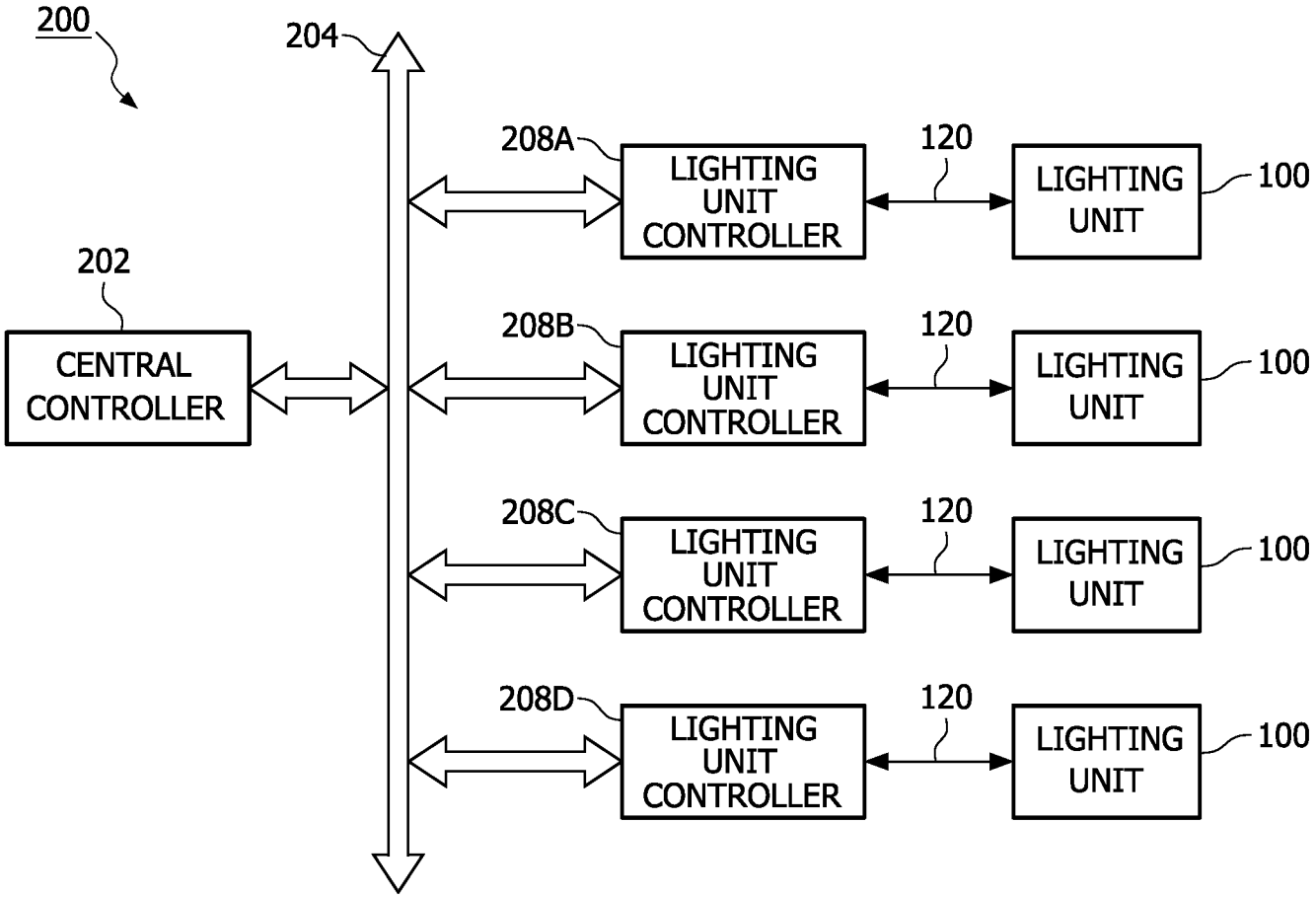
FIG. 2 is a diagram illustrating a networked system of LED-based lighting units of FIG. 1.

FIG. 2 illustrates an example of a networked lighting system 200 according to one embodiment of the present disclosure, in which a number of lighting units 100, similar to those discussed above in connection with FIG. 1, are coupled together to form the networked lighting system. It should be appreciated, however, that the particular configuration and arrangement of lighting units shown in FIG. 2 is for purposes of illustration only, and that the disclosure is not limited to the particular system topology shown in FIG. 2.

Additionally, while not shown explicitly in FIG. 2, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 1) may be associated with any one or more of the lighting units of the networked lighting system 200. Alternatively (or in addition to the foregoing), one or more user interfaces and/or one or more signal sources may be implemented as "stand alone" components in the networked lighting system. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 2, the lighting system 200 may include one or more lighting unit controllers (hereinafter "LUCs") 208A, 208B, 208C, and 208D, wherein each LUC is responsible for communicating with and generally controlling one or more lighting units 100 coupled to it. Although FIG. 2 illustrates one lighting unit 100 coupled to each LUC, it should be appreciated that the disclosure is not limited in this respect, as different numbers of lighting units may be coupled to a given LUC in a variety of different configurations (serially connections, parallel connections, combinations of serial and parallel connections, etc.) using a variety of different communication media and protocols. Each LUC in turn may be coupled to a central controller 202 that is configured to communicate with one or more LUCs. Although FIG. 2 shows four LUCs coupled to the central controller via a generic connection 204 (which may include any number of a variety of conventional coupling, switching and/or networking devices), it should be appreciated that according to various embodiments, different numbers of LUCs may be coupled to the central controller 202. Additionally, according to various embodiments of the present disclosure, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present invention, the central controller 202 shown in FIG. 2 may be configured to implement Ethernet-based communications with the LUCs, and in turn the LUCs may be configured to implement DMX-based communications with the lighting units 100. In particular, in one aspect of this embodiment, each LUC may be configured as an addressable Ethernet-based controller and accordingly may be identifiable to the central controller via a particular unique address (or a unique group of addresses) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via a DMX protocol, based on the Ethernet communications with the central controller.

More specifically, according to one embodiment, the LUCs 208A, 208B, and 208C shown in FIG. 2 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using a DMX protocol, in response to which the respective sources of the lighting units are controlled via any of a variety of signaling techniques (e.g., PWM).

It should again be appreciated that the foregoing example of using multiple different communication implementations (e.g., Ethernet/DMX) in a lighting system according to one embodiment of the present disclosure is for purposes of illustration only, and that the disclosure is not limited to this particular example. From the foregoing, it may be appreciated that one or more lighting units as discussed above are capable of generating highly controllable variable color light over a wide range of colors, as well as variable color temperature white light over a wide range of color temperatures.

Referring now to FIGS. 3A-3D, there are depicted front, rear, side, and top perspective views of a high-output architectural lighting fixture (or luminaire) 300, in accordance with some implementations of the present invention. The fixture 300 employs several lighting units (for example, two units 301, 302 shown in FIG. 3A) fixedly secured within the fixture, disposed at an angle relative to each other, and capable of projecting a narrow beam of light over considerable distance towards a target object. As discussed in detail below, the fixture is configured to achieve significantly advantageous light extraction and heat dissipation properties. The fixture 300 can further be a part of a networked system of lighting fixtures, as described above with reference to FIGS. 1-2.

As shown in FIGS. 3A-3D, in some embodiments, the lighting fixture 300 includes a positioning system comprised of a pair of yoke arms 310 attached to a yoke base 315. The yoke arms can be made from aluminum, for example, by casting. The yoke base can be made from steel, for example, by stamping. The yoke arms are further attached to respective LED-based lighting units 301, 302 via a pair of supports 320 so as to form a split fixture housing 316.

In many embodiments, the supports may be made from aluminum, and fixedly orient the lighting units relative to one another and provide the yoke's pivot point. The supports are attached to a housing rotation assembly 323, which allows the split fixture housing to be rotated while the yoke arms remain fixed. The rotation assembly includes a fixture-retaining bracket 325 that is permanently tethered to the supports and further includes a fine rotation indicator 328

Figure 3A:
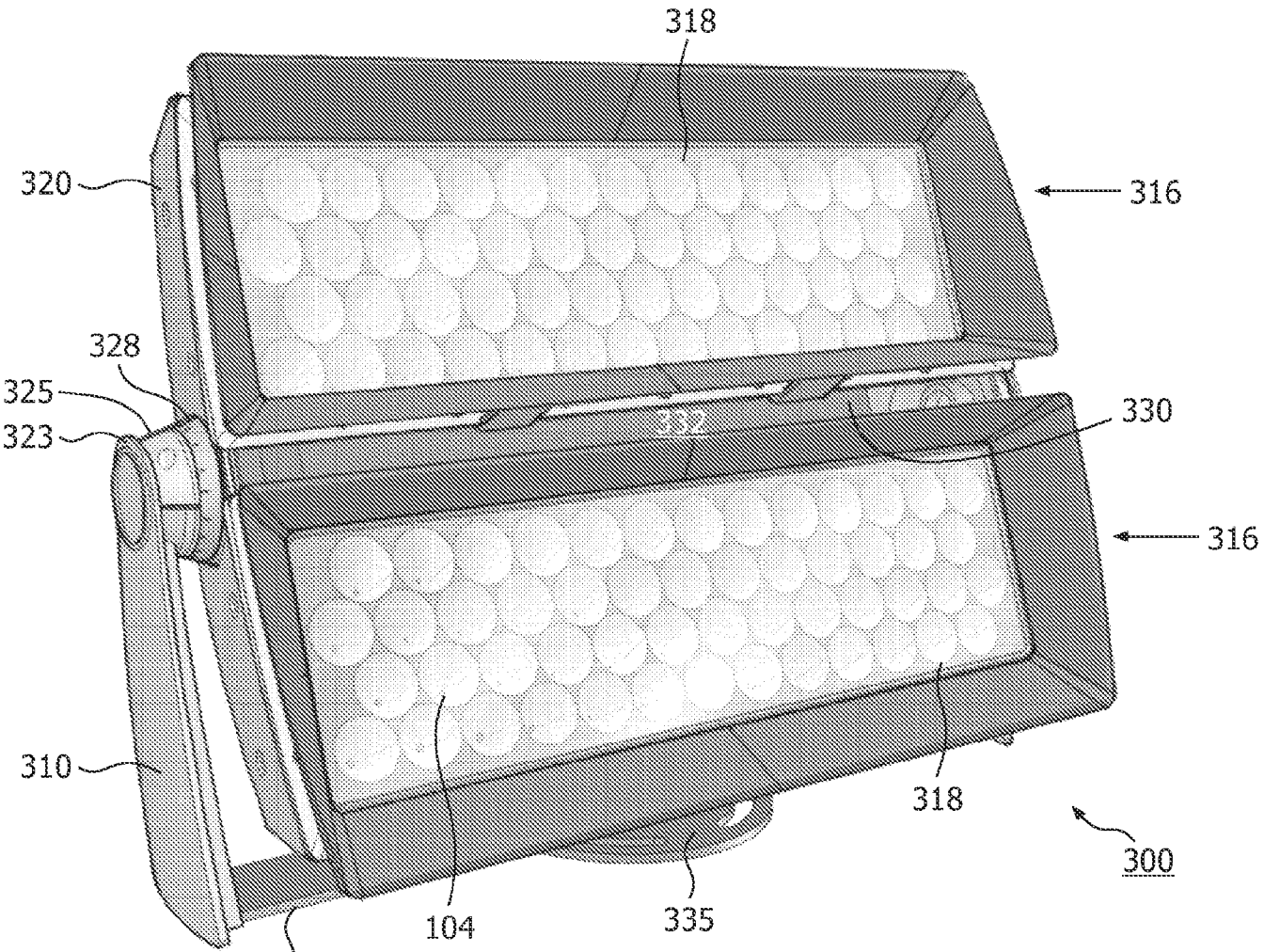
FIGS. 3A-3G illustrate various views, some being partial views, of an architectural luminaire in accordance with some embodiments of the invention.
Figure 3B:
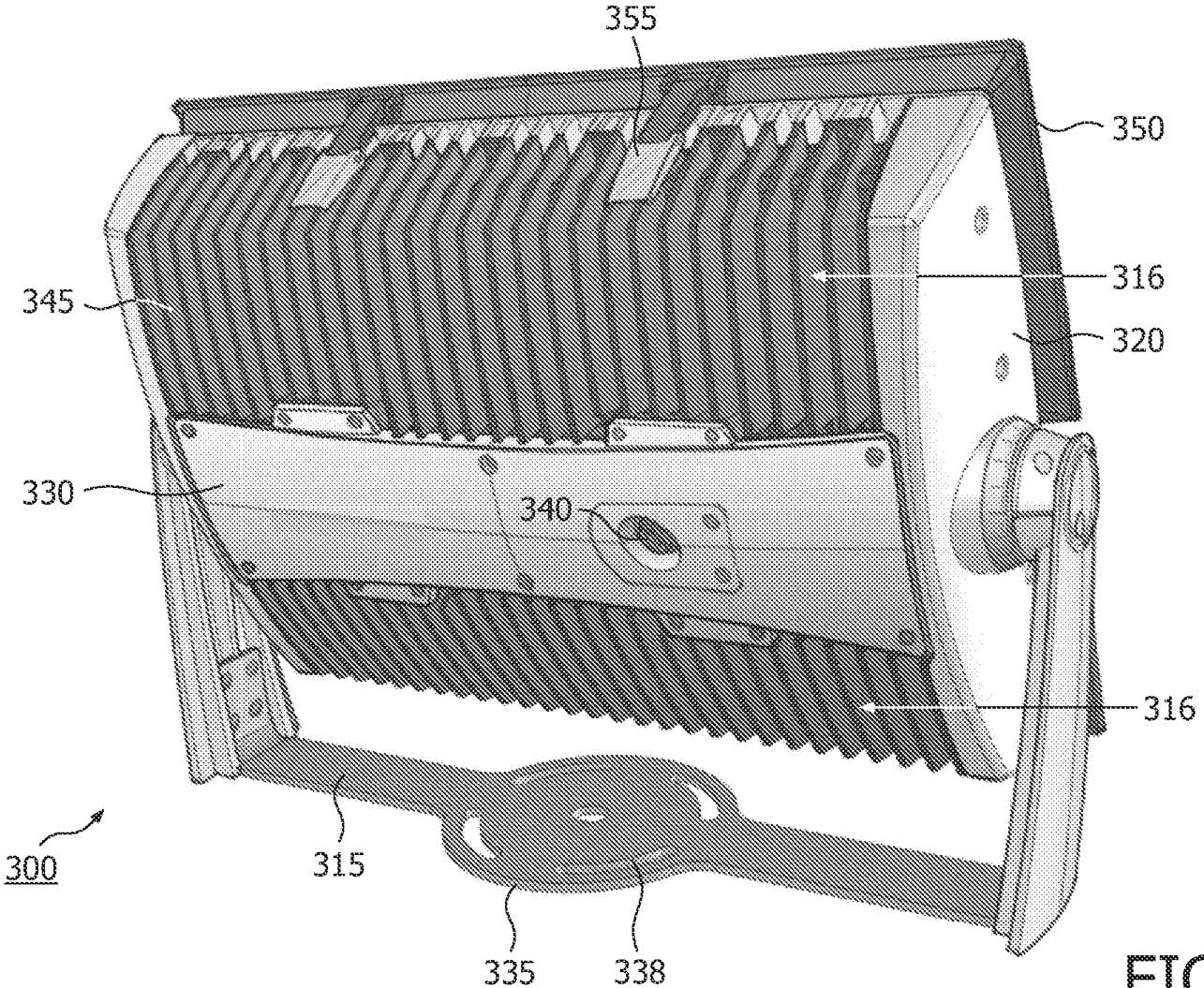
Figure 3C:
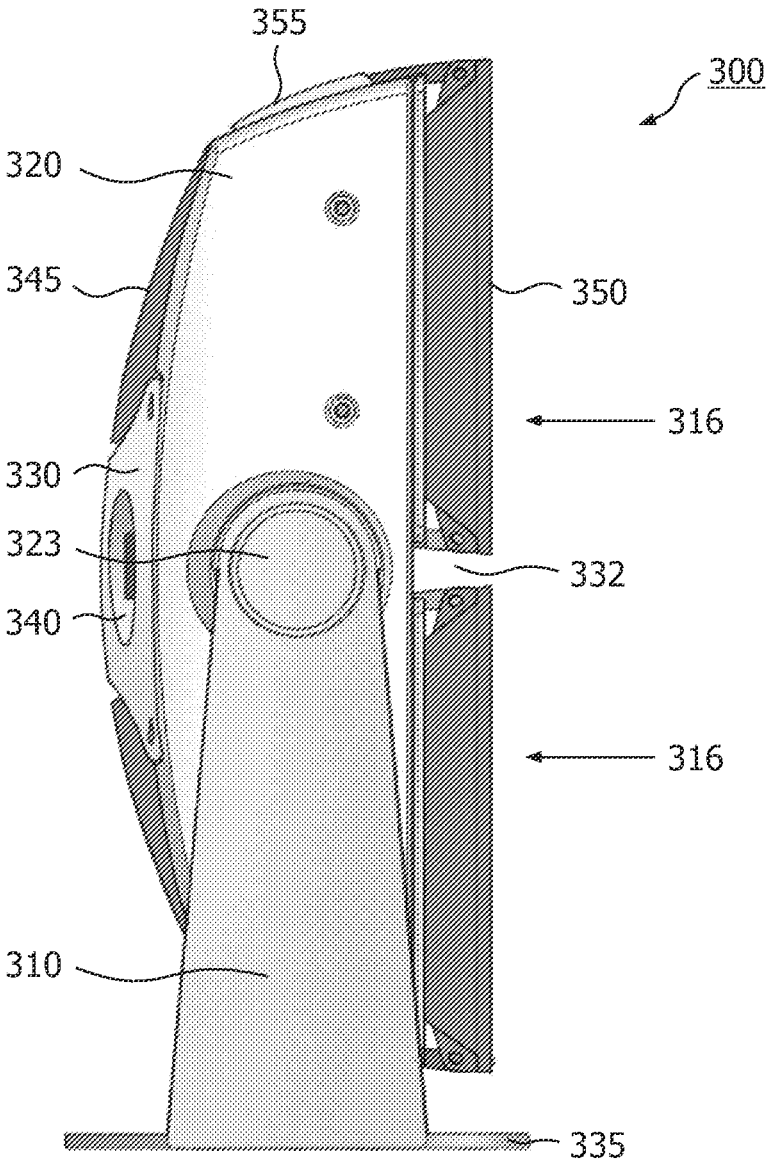
Figure 3D:
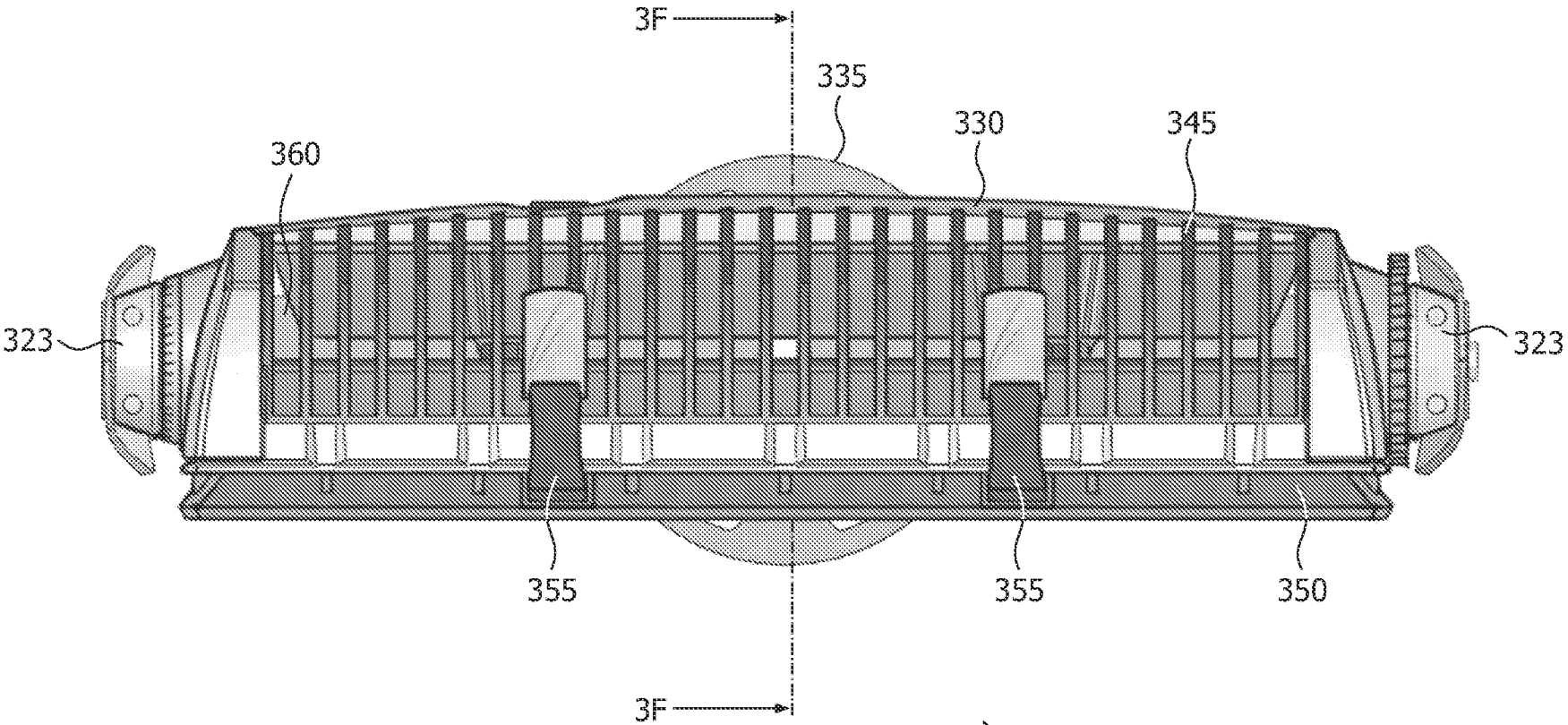
Figure 3E:
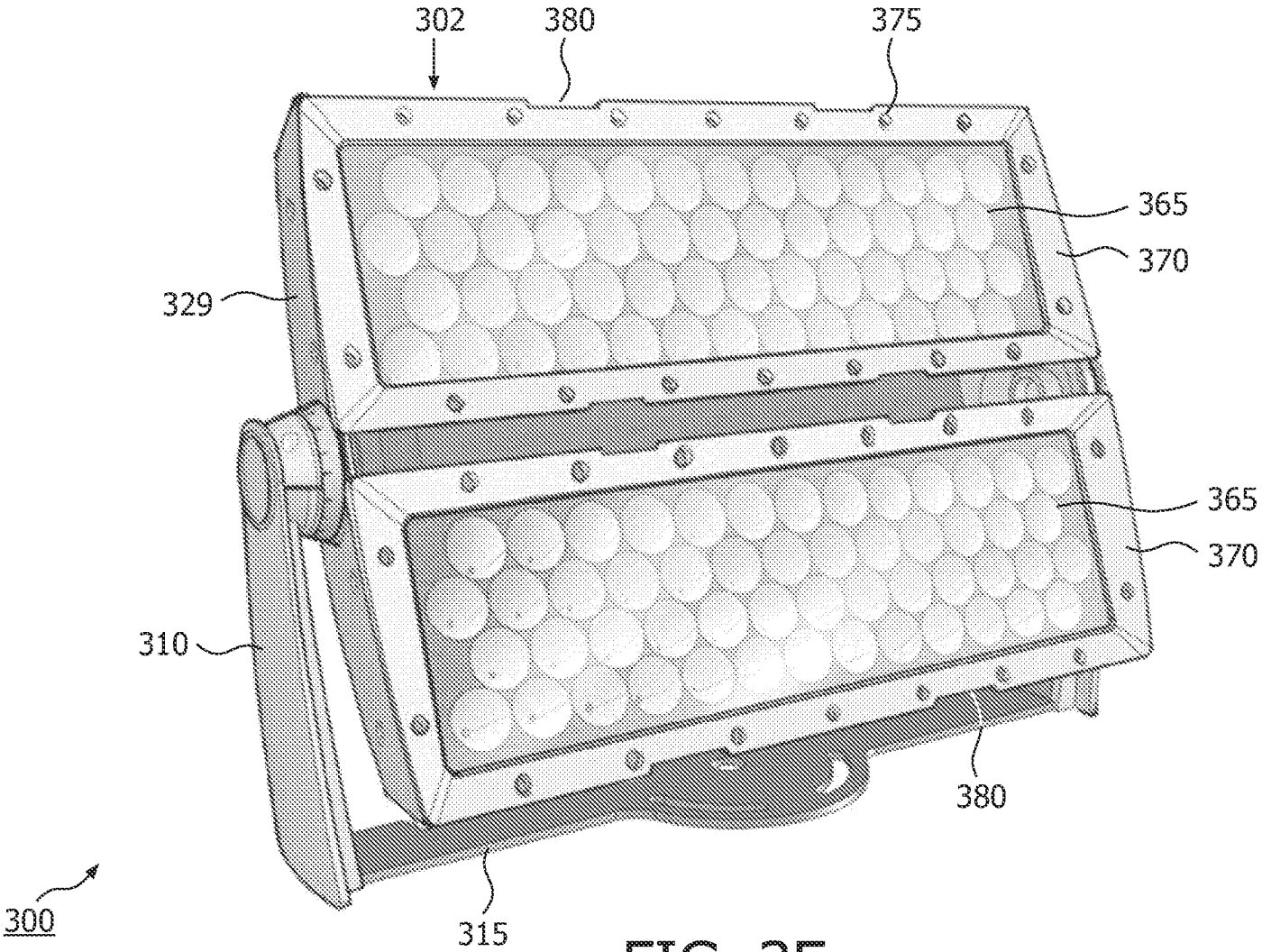

In other embodiments of the invention, the lighting units 301, 302 are fixedly arranged in a frame 329 and the yoke arms are attached directly to the frame without the supports 320 as shown in FIG. 3E via, for example, the housing rotation assembly 323, or via side locking bolts (not shown). The latter embodiment lets the end user reliably secure the lighting units 301, 302 relative to the yoke arms with a standard wrench.

Prior to the operation, the fixture 300 is installed at a desired site via a mounting foot 335 of the yoke base 315. Referring particularly to FIG. 3B, the mounting foot 335 includes multiple arc-shaped slots 338 for mounting and enabling full 360° rotation, as well as rough aiming of the fixture. In some embodiments, split fixture housing 316 can be rotated using rotation assembly 323, to direct the light across the architectural surface, which can be on the order of 300-500 feet in length.

Referring again to FIG. 3A-3D, the lighting fixture 300 further includes a controller housing 330 containing the power supply and control circuitry for powering the light sources and controlling the light output of the lighting units. As indicated in FIG. 3A, although housing is mounted at the rear of fixture, it can be seen from the front side, due to a gap 332 that exists between the lighting units. As will be discussed in greater detail with respect to FIG. 3G, the gap is useful in the thermal management of the fixture.

Power and data sources (not shown) are preferably connected to the fixture 300 via a waterproof power-data connector 340. Viewing FIG. 3B in conjunction with FIG. 3C, each of lighting units of the split fixture housing 316 includes a plurality of heat dissipating fins 345, which define a unitary structure that can be made from aluminum or other heat-conducting material by casting, molding, or stamping. The fins 345 function to dissipate heat generated by the LED-based lighting units during the operation of the fixture 300. In one implementation, fins 345 are configured to extend to a compound curve surface that matches in a sleek design with the surface of controller housing 330, as shown in FIGS. 3A-3G. In this manner, the fins 345 also function to protect much of the controller housing, thereby, for example, shielding the housing from accidental impact or rough handling during installation.

In some embodiments, each lighting unit of the fixture 300 includes a protective frame 350, which can be made from a plastic, such as acrylonitrile-butadiene-styrene ("ABS"), by molding. The frame 350 is secured to fins 345 of each lighting unit via a plurality of latches 355.

As discussed in further detail below, in various aspects of the invention, the lighting fixture 300 is configured and arranged such that its constituent parts are coupled together to facilitate significant air flow. In some exemplary implementations, the lighting units 301, 302 and a controller housing 330 (in which is disposed power supply and control circuitry) are mechanically coupled together by two supports 320 (or directly to yoke arms) in such a way as to allow significant air gaps between each of the lighting units and the controller housing 330 to facilitate heat-dissipation. Furthermore, with reference in particular to FIG. 3D, in various implementations of the technology, in each lighting unit, a gap 360 exists between adjacent heat dissipating fins 345 for facilitating air flow throughout fixture for cooling.

The fixture 300 is dimensioned for high optimal performance and, in many implementations, is relatively large in size in comparison to conventional LED lighting fixtures of a similar type. For example, in one implementation, the fixture 300 weighs about 40 pounds (about 18.2 kg) and has the following dimensions: about 24 inches (about 61 cm) in length, 24 inches (about 61 cm) in width, and 24 inches (about 61 cm) in height.

As illustrated in FIG. 3E, each lighting unit of the fixture 300 further includes a first lens 365, which can be made from sheet acrylic by molding. The lens 365 is configured to improve, for example, the uniformity of the light emitted by the fixture. A light-diffusing film, for example, a holographic film, can also be disposed over an interior surface of the first lens, to provide further beam-shaping optical functionality. In each lighting unit, the first lens is secured to the unitary structure of heat-dissipating fins 345 by a second frame 370, which can be made from aluminum, such as by casting. The frame 370 includes a plurality of holes 375 for bolting the frame from the front surface using screws. The frame further includes a plurality of notches 380 around its outer perimeter for partially receiving/locating the hooks and latches 355 of frame 350. A gasket (not shown) between the second frame and the first lens protects the interior components of a given lighting unit from the ambient environment. The lens frame 370 is secured to heat-dissipating fins 345 using screws 392. The lens frame further includes lens-retaining edges 395, which protrude over a portion of lens 365, thereby retaining it.

In particular implementations of the invention, the lens 365 are readily exchangeable spread lenses of 8°, 13°, 23°, 40°, 63°, and an asymmetric 5°×17° angles, enabling a variety of photometric distributions for a multitude of applications, including spotlighting, wall grazing, and asymmetric wall washing.

Figure 3F:
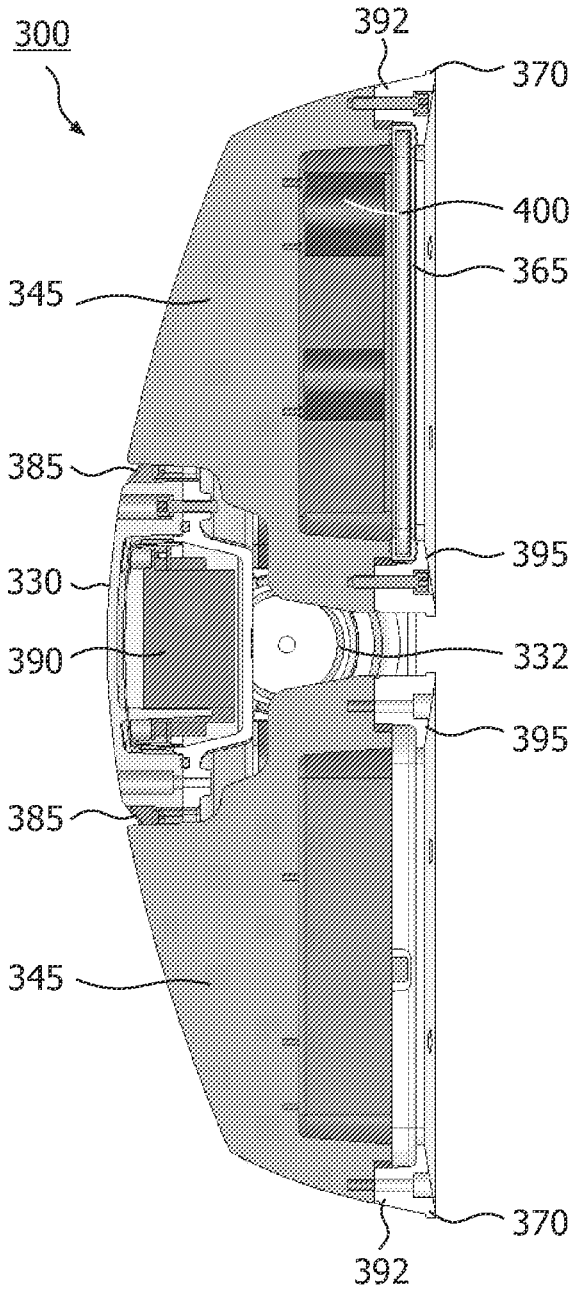

Depicted in FIG. 3F is a partial cross-section of fixture 300 taken along the cutting plane line 3F-3F, as illustrated in FIG. 3D. In many implementations of the technology, there is a gap 385 between each lighting unit 301, 302 and housing 330, for allowing ambient air to enter the fixture. A power supply and control circuitry 390 are located within controller housing 330. Methods and apparatus for controlling the fixture disclosed herein can be found in, for example, U.S. Pat. Nos. 7,233,831 and 7,253,566. Furthermore, in many exemplary implementations, the power supply and control circuitry is based on a power supply configuration that accepts an AC line voltage and provides a DC output voltage to provide power to one or more LEDs as well as other circuitry that may be associated with the LEDs. In various aspects, suitable power supplies may be based on a switching power supply configuration and be particularly configured to provide a relatively high power factor corrected power supply. In one exemplary implementation, a single switching stage may be employed to accomplish the provision of power to a load with a high power factor. Various examples of power supply architectures and concepts that at least in part are relevant to or suitable for the present disclosure are provided, for example, in U.S. Pat. No. 7,256,554.

Figure 3G:
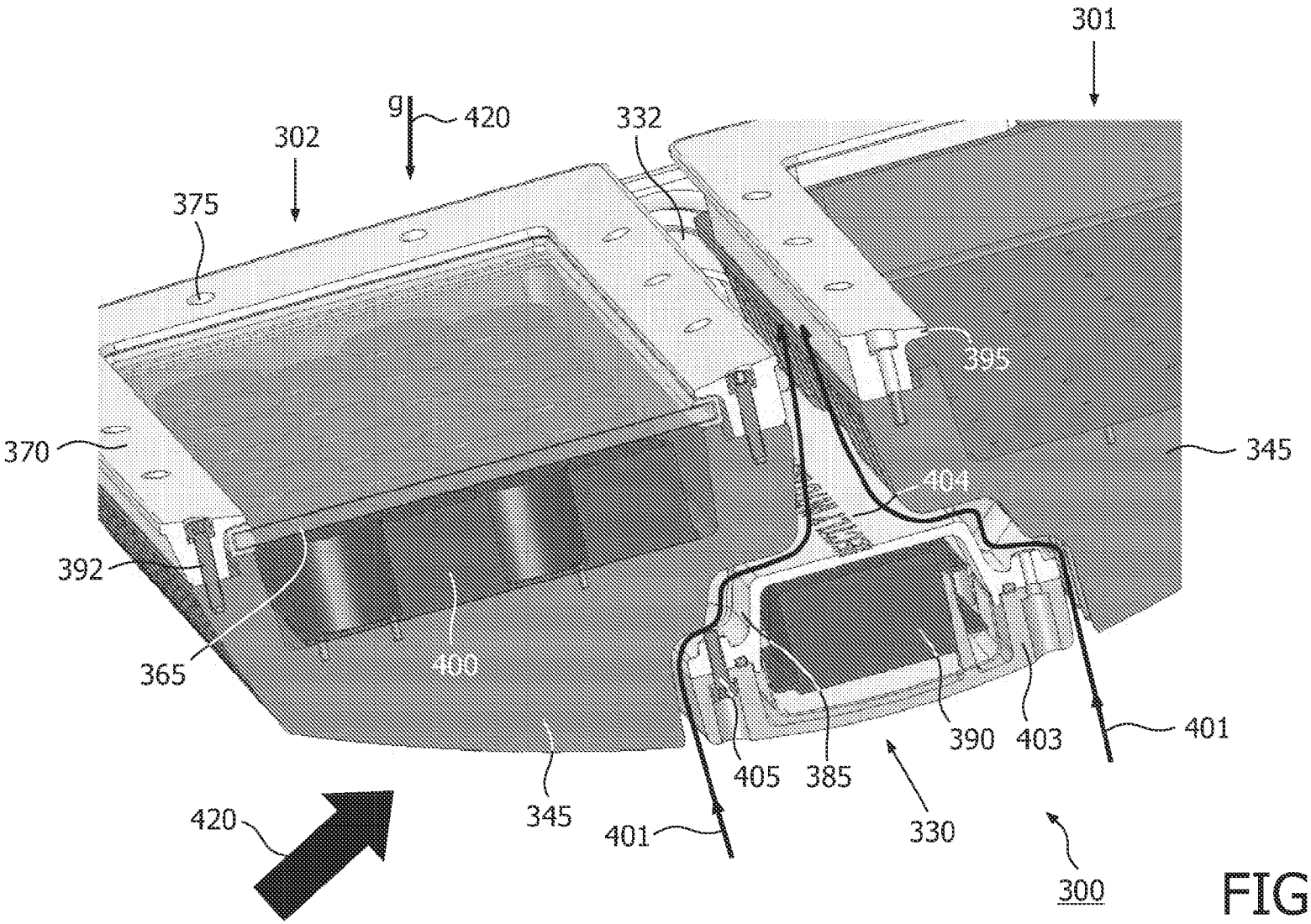

Referring to FIG. 3G, there is depicted a partial, cross-sectional, perspective view, of fixture 300, taken along the cutting plane line 3F-3F, as illustrated in FIG. 3D. The view in FIG. 3G is provided to facilitate an understanding of the mechanism by which fixture 300 is cooled by the ambient air. The cross-section in FIG. 3G is taken through the bodies of a pair of opposing heat-dissipating fins 345, which are located on different lighting units 100. Gaps 385 between power supply housing 330 and lighting units 100 connect with gap 332 between lighting units 100, thereby providing an unobstructed path for the flow of ambient air through the fixture, as represented by arrows 401. The ambient air also flows into gaps 360 (not shown) between adjacent fins of each sub-unit, as indicated by an arrow 402, and can also be exhausted via gaps 385 and 332. In general, the technology disclosed herein contemplates creating and maintaining a "chimney effect" within the fixture, employed alone or in combination with other factors relating to decreased thermal resistance, such as increased surface area of heat dissipating elements and improved thermal coupling between the LED(s) of the fixture and one or more heat dissipating elements. The resulting high-flow-rate, natural convection cooling system is capable of efficiently dissipating the waste heat from an exterior architectural lighting fixture without requiring active cooling, such as by the use of a fan. During the operation of the lighting fixture, air gaps are oriented in a substantially vertical orientation so as to create a chimney effect within the fixture enhancing air flow along the heat sink/fins. In various aspects, the combination of increased fixture surface area, increased thermal flux away from LEDs and associated electronics, and the "chimney effect," respectively contribute to decrease thermal resistance between the LEDs and the ambient. The heat-dissipating structure is configured to have a significant surface area for effectively facilitating heat flow and a "chimney effect." As skilled artisans will readily recognize, a "chimney effect" (also known as a "stack effect") is the movement of air into and out of structures, e.g. buildings or containers, driven by buoyancy, occurring due to a difference between interior and exterior air density resulting from temperature and moisture differences. The technology disclosed herein employs this effect to facilitate heat dissipation when fixture 300 is in operation.

As indicated by arrows 401 and 402 in FIG. 3G, when fixture 300 is positioned to "throw" light upwards, along a large architectural surface (the direction of gravity, g, is indicated by arrow 420), a cool ambient air is drawn into the fixture through gaps 360 and 385. The cooling air is then exhausted through gap 332. In this manner, the heat generated by the LED-based lighting units flows through fins 345 and is dissipated by the cooling ambient air. Improved heat dissipation efficiency, in turn, leads to improved energy conversion and better performance and longevity of the LED-based lighting units. Thus, by decreasing thermal resistance between the LED lighting units and the ambient air via a combination of features, such as a large surface area of the heat-dissipating fins and creating a "chimney effect" via the particular fixture design, the fixture's reliability and performance is enhanced.

As further illustrated in FIG. 3G, each lighting unit includes a compartment 397, in which are disposed multiple LED-based light sources 104, each source being provided and aligned with a corresponding reflector optic 400 designed to reflect and direct the light emitted by the light sources. The number of LED light sources/reflector optic pairs per lighting unit is selected to provide the output/lumens required for illuminating large architectural structures. In some exemplary implementations, some or all of the light sources in a given lighting unit may be "chip-on-board" (COB) LED assemblies, i.e., one or more semiconductor chips (or "dies") in which one or more LED junctions are fabricated, wherein the chip(s) is/are mounted (e.g., adhered) directly to a printed circuit board (PCB). The chip(s) is/are then wire bonded to the PCB, after which a glob of epoxy or plastic may be used to cover the chip(s) and wire connections. In one aspect of this implementation, multiple such assemblies serving as respective light sources 104 may be mounted to a common mounting board or substrate of a lighting unit. In other aspects, LED COB assemblies serving as light sources may be configured to generate various spectra of radiation, as discussed further below. Suitable LEDs for emitting white or colored light at high intensities can be obtained from Cree, Inc. of Durham, N.C., or Philips Lumileds of San Jose, Calif. In one implementation, fixture 300 includes about 108 LED sources in a close-packed arrangement, and is capable of providing a total output of about 5000 lumen and about one foot-candle (about 10 lux) at a distance within a range of about 300 to 500 feet from the fixture 300. The amount of power to operate such a large number of LED light sources is on the order of 250 watts consumed by the LED sources alone, and 350 watts consumed by the entire fixture. Since the LED sources do not dissipate heat radiatively, the heat must be dissipated by conduction and convection, and the fixture is configured as described above to do so successfully. Thus, fixture 300 provides excellent light output, and it is capable of operating for about 30,000 to 80,000 hours without replacement of the LED light sources 104 at least in part due to the improved thermal management properties of the fixture, as discussed above.

As further illustrated in FIG. 3G, an outer half 403 and an inner half 404 of power supply housing 330 are attached to one another using a plurality of screws 405.

Figure 4A:
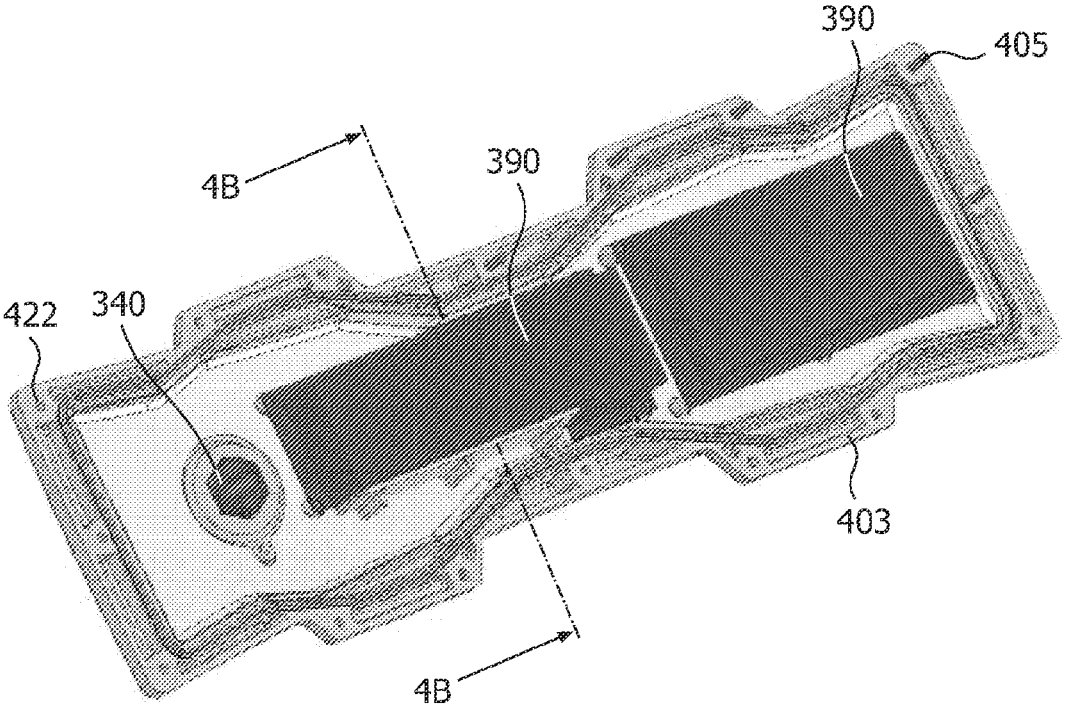
FIGS. 4A-4B illustrate a power supply and control housing of the architectural luminaire of FIGS. 3A-3G in accordance with various implementations of the present technology.
Figure 4B:
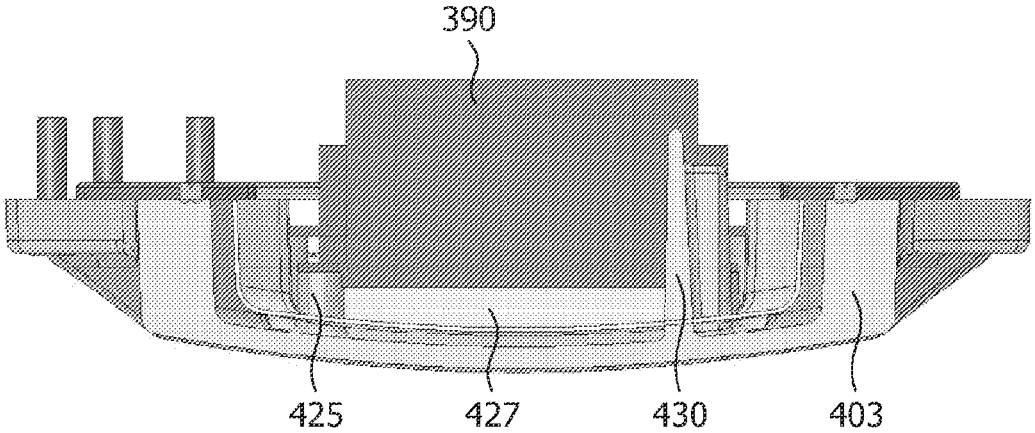

Illustrated in FIG. 4A is a perspective view of outer half 403 of housing 330, including the configurations of the power supply and control circuitry 390. Outer half 403 has holes 422 for receiving screws 405. Depicted in FIG. 4B is a cross-sectional view of outer half 403 taken along the cutting plane line 4B-4B, as illustrated in FIG. 4A. The outer half of power supply housing 330 further includes a plurality of standoffs 425, which raise power supply and control circuitry 390 off of the housing, defining a gap 427 there between, which improves the safety of fixture 300 and reduces the risk of electrical shorting between circuitry 390 and housing 330. Outer half 403 further includes walls 430, which are in thermal-but not electrical-contact with the power supply and control circuitry, for dissipating heat from the circuitry, toward the housing, to the ambient air.

In various implementations of the technology, the lighting units within the split fixture housing 316 have the same configuration, including the layout of the LED light sources 104 and their spectral outputs. In other implementations, the spectral properties of one lighting unit differ from those of the other lighting unit. Also, the lighting units 301, 302 can be addressed and controlled simultaneously and identically or independent of one another, as discussed in detail with reference to FIG. 1, thereby providing improved versatility of color gamut and color rendering, particularly when the spectral outputs from both lighting units combine to illuminate a target object. For example, the lighting unit 301 can provide red, green and blue light (RGB), while the lighting unit 302 provides only white light or emerald green or cyan. Such a configuration can be useful for realizing creamier pastels, for example. Alternatively, one lighting unit can provide RGB, while the other lighting unit provides another triplet of colors/wavelengths, including amber, ultra-violet light, etc. Such a configuration is useful for providing a greater color gamut.

In addition, the split design of the fixture supports various combinations of illumination configurations. With each lighting unit of the fixture being individually addressable and controllable, it is possible to employ different lens at the lighting units. For example, in some embodiments, one type of spread lens can be used on the fixture's lower unit to illuminate a large façade with color at street level, and a different spread lens to project a contrasting or complementary color hundreds of feet up the building's wall. In other embodiments, the lighting units can be positioned within the fixture at a predetermined angle such that the beams generated by them generally overlap within a desirable range from the fixture 300. As mentioned above, this configuration is suitable for providing a greater color gamut and luminous flux when illuminating an object disposed with the range.

As discussed above, it is desirable to project a beam of light at distances on the order of hundreds of feet. However, due to cycle time of a TIR optic, it is very difficult to obtain a narrow beam angle, for example, 5° beam due to the size of that part. Thus, referring to now FIGS. 5A-5E, reflector optic 400 is designed to provide a densely-packed configuration of LED lighting units and to produce a very narrow beam angle, for example, a 5-degree beam angle. However, a narrower beam angle can result in a relatively large-sized optic. The reflector optic of the disclosure is uniquely configured into a plurality of portions, to provide the requisite size while optimizing the density of LED lighting units and minimizing damage to secondary optics located in the reflector optic.

Figure 5A:
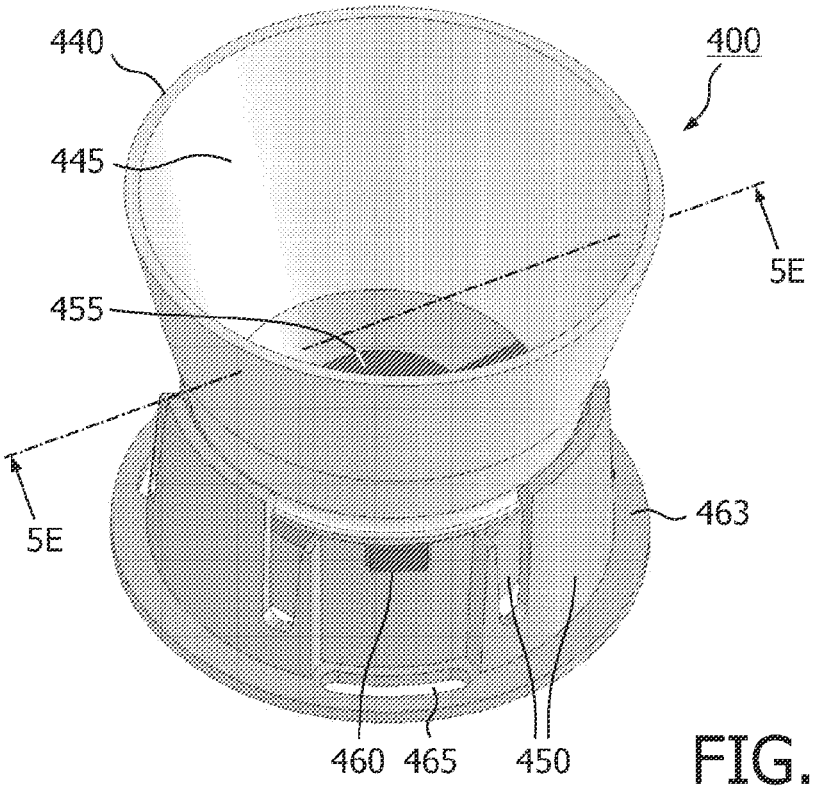
FIGS. 5A-5E illustrate a reflector optic suitable for use with the architectural luminaire of FIGS. 3A-3G.

Referring particularly to FIG. 5A, in various embodiments of the invention, reflector optic 400 includes a top portion 440, having an inner surface 445, and a bottom portion 450. Intermediate to the top and bottom portions is a second lens 455, which can be made of a clear polycarbonate by, for example, molding. During molding the lens is preferably center-gated to minimize undesirable issues with mold flow. Other materials, for example, acrylic, other types of plastic, or stamped/formed/cut metal can also be used.

The top and bottom portions can be made from a polycarbonate, such as by molding, and are coated with a reflective material, such as aluminum, silver, gold, or other suitable reflective material, for reflecting the light emitted by the LED lighting units. Splitting the reflector optic in two parts with subsequent assembly is not only simplifies lens mounting over the LED light sources, but also improves coating quality.

The second lens is secured between the top and bottom portions via three securing arms 460. The reflector optic further includes a mounting foot 463, defining three arc gaps 465, for mounting the reflector optic with screws to a printed circuit board (PCB) having the LEDs. The top and bottom portions are separate pieces that can be mounted at separate times, achieving numerous benefits described in greater detail with reference to FIGS. 6A-6C.

Figure 5B:
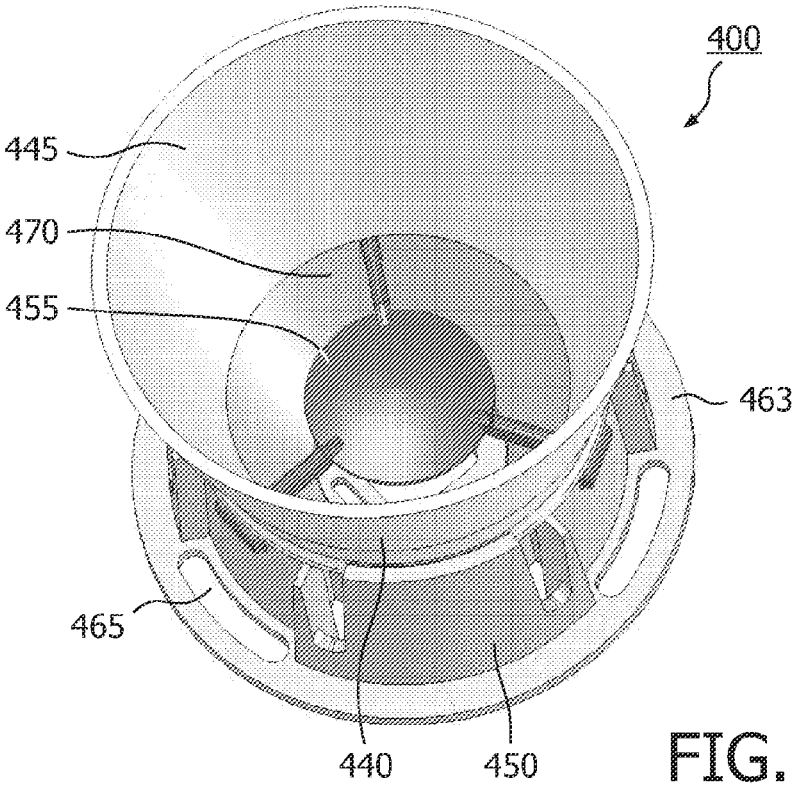
Figure 5C:
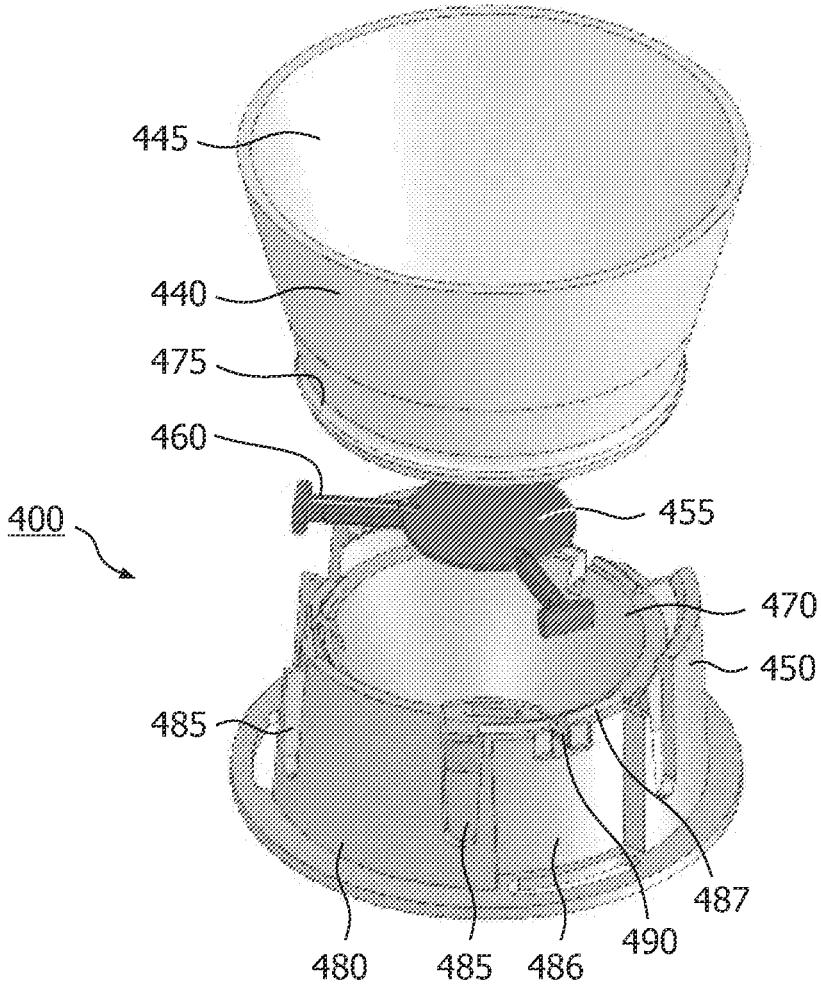
Figure 5D:
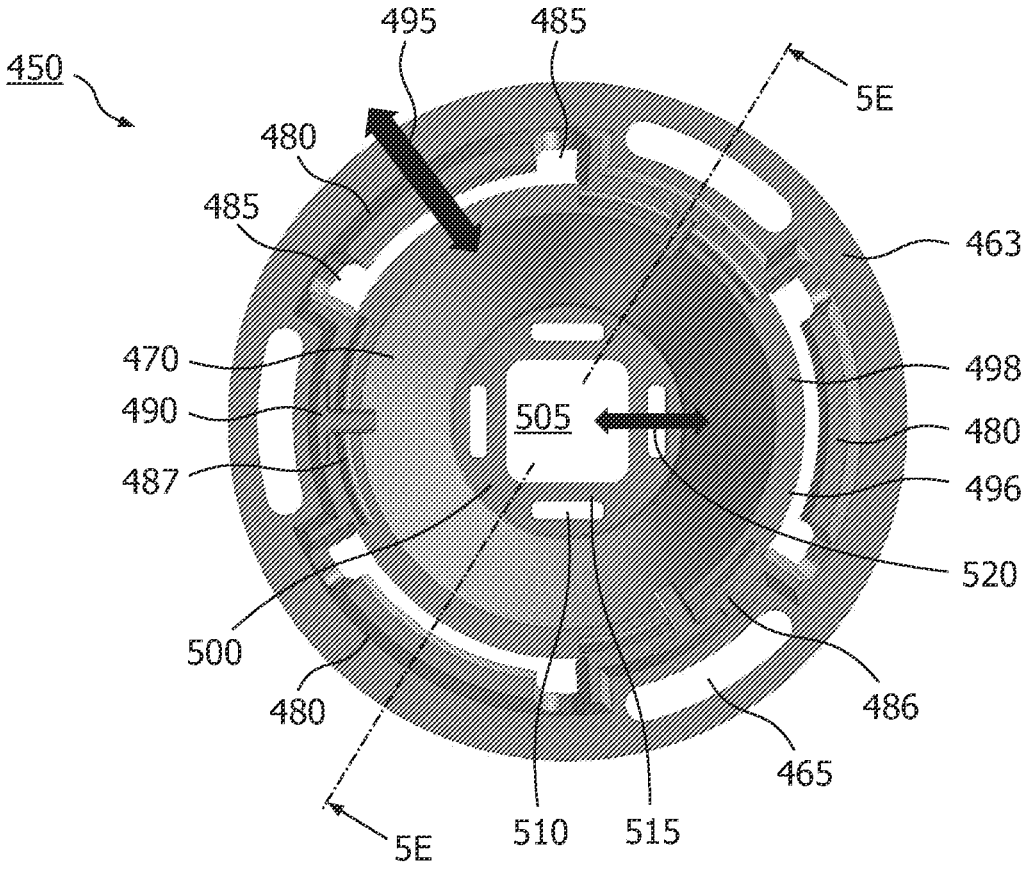

Referring to FIGS. 5B-5D, a surface 470 of bottom portion 450 is coated with a reflective material, and is aligned with surface 445 to provide a smooth surface.

Top portion 440 includes a protruding edge 475 configured to snap into three retention walls 480 of bottom portion 450. The bottom portion defines a deep notch 485 between each retention wall 480 and an adjacent support wall 486. Each of the three support walls has a top surface 487 that defines a shallow notch 490, into which one of securing arms 460 of second lens 455 are placed.

Referring particularly to FIG. 5D, retention walls 480 are able to move radially, as indicated by an arrow 495, to engage the protruding edge of the top portion. Bottom portion 450 includes a wall 496, which defines reflective surface 470. Wall 496 is contiguous with support walls 486, such that a top surface 498 of wall 496 is coextensive with surfaces 487 of support walls 486. Bottom portion 450 further includes a bottom surface 500, which defines a hole 505 in which, during the assembly of the fixture, an individual LED light source is disposed. The bottom surface further defines slots 510 and four flexible members 515, for snugly engaging the LED light source. The flexible members can bow in the manner indicated by an arrow 520 to adjust for differences in size among individual LED lighting sources.

Figure 5E:
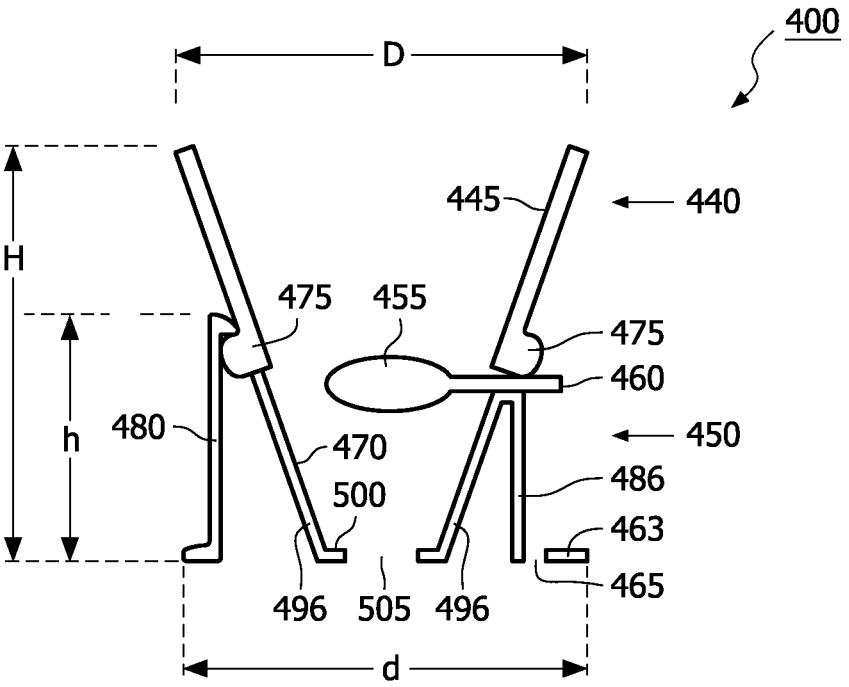

Referring now particularly to FIG. 5E, there is depicted a cross-sectional view of reflector optic 400 taken along the cutting plane line 5E-5E, as illustrated in FIGS. 5A and 5D. In various embodiments, a diameter, D, of top portion 440, is about equal to a diameter, d, of bottom portion 450, and is equal to about 1.4 inches (3.5 centimeters); a height, H, of the reflector optic is about 1.3 inches (3.25 centimeters); and a height, h, of the bottom portion is about 0.5 inches (1.25 centimeters).

Figure 6A:
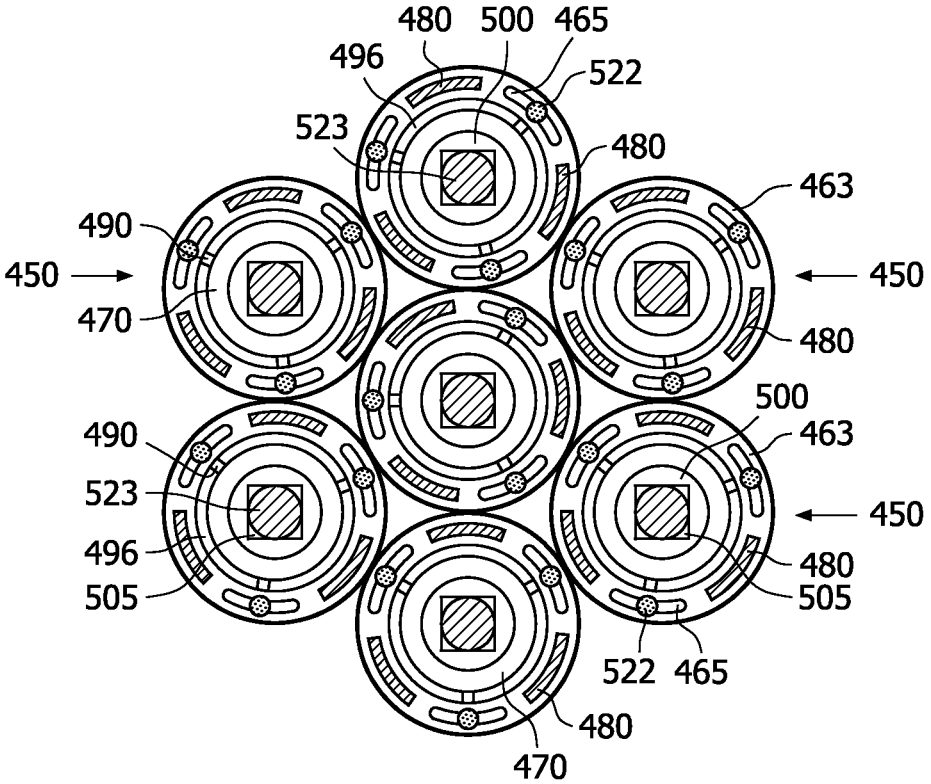
FIGS. 6A-6C illustrate a method for mounting the reflector optic of FIGS. 5A-5E in the architectural luminaire of FIGS. 3A-3G.
Figure 6B:
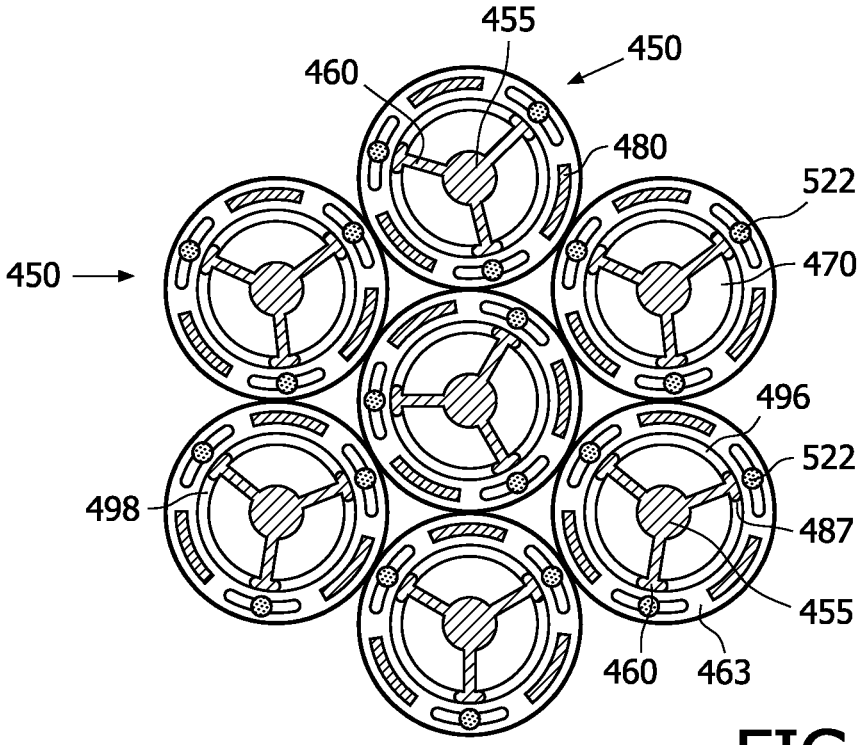
Figure 6C:
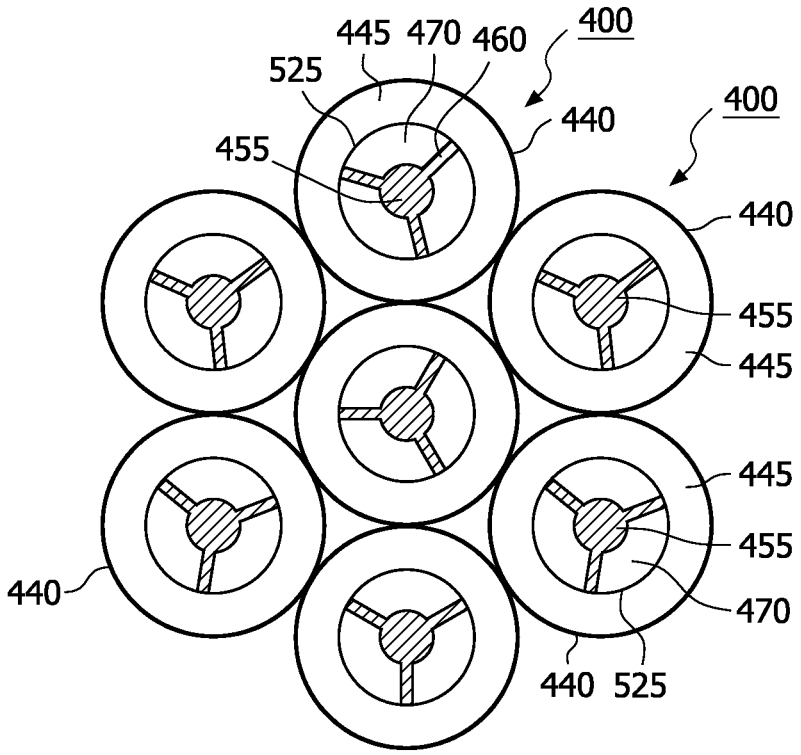

Referring to FIGS. 6A-6C, reflector optics 400 are mounted to achieve a densely-packed configuration of LED light sources/COB assemblies, thereby improving the light output and "throw" of the architectural luminaire. Due at least in part to the split configuration including top portion 440 and bottom portion 450, the reflector optics can be mounted by fasteners, such as a plurality of screws 522, obviating the need for adhesives. By employing screws, the reflector optics are readily removed and replaced, allowing access to the LED PCB for replacement/repair while minimizing waste generation.

Referring in particular to FIG. 6A, in the construction of fixture 300, bottom portions 450 of the reflector optics are first mounted onto the LED PCB by screws 522. Bottom surface 500 of each bottom portion is aligned to receive at least a portion, such as the epoxy/plastic primary lens, of the LED light source 104 (e.g., COB assembly) within hole 505. After being placed over the LED source, each bottom portion is affixed to the PCB.

As illustrated in FIG. 6B, after the bottom portions 450 of a number of reflector optics are mounted, such that adjacent reflector optics abut one another at the mounting foot 463, second lenses 455 are mounted onto the bottom portions, such that securing arms 460 rest in notches 490 (shown in FIG. 6A) of top surfaces 487. Then, as illustrated in FIG. 6C, top portions 440 are snapped into bottom portions 450, to define an interface 525, where the top surface 498 (shown in FIG. 6B) of each lower portion abuts with its corresponding top portion. If the reflector optic did not have a split design, it would be very difficult, if not impossible, to access mounting features along the mounting foot, unless gaps were provided between the bases of adjacent optics. In this manner, the luminaire of the disclosure allows a close-packed configuration that does not require the use of adhesives and which improves light output per unit area of the fixture. In various other embodiments, an adhesive can be used to affix the reflector optic to the LED PCB. The split configuration of the reflector optic of the disclosure provides the further advantage of improved handling of second lens 455. That is, second lens 455 can be positioned within reflector optic 400 in a manner that minimizes scratching and breakage of the second lens and prevents scratching of the coating on surface 445.

In various embodiments, instead of employing screws to attach bottom portion 450 to the LED PCB, each of arc gaps 465 in mounting foot 463 is configured to provide a snap connection to a pin that is affixed to the LED PCB. The arc gap can be configured to snap onto the pin while rotating the bottom portion about its central axis. Alternatively, the arc gap can be configured to snap onto the pin by pressing the bottom portion downward, toward the LED PCB.

In various embodiments of the invention, the final profile of the reflector optic is an optimized spline surface, rather than a parabola to improve optical extraction.

Figure 7:
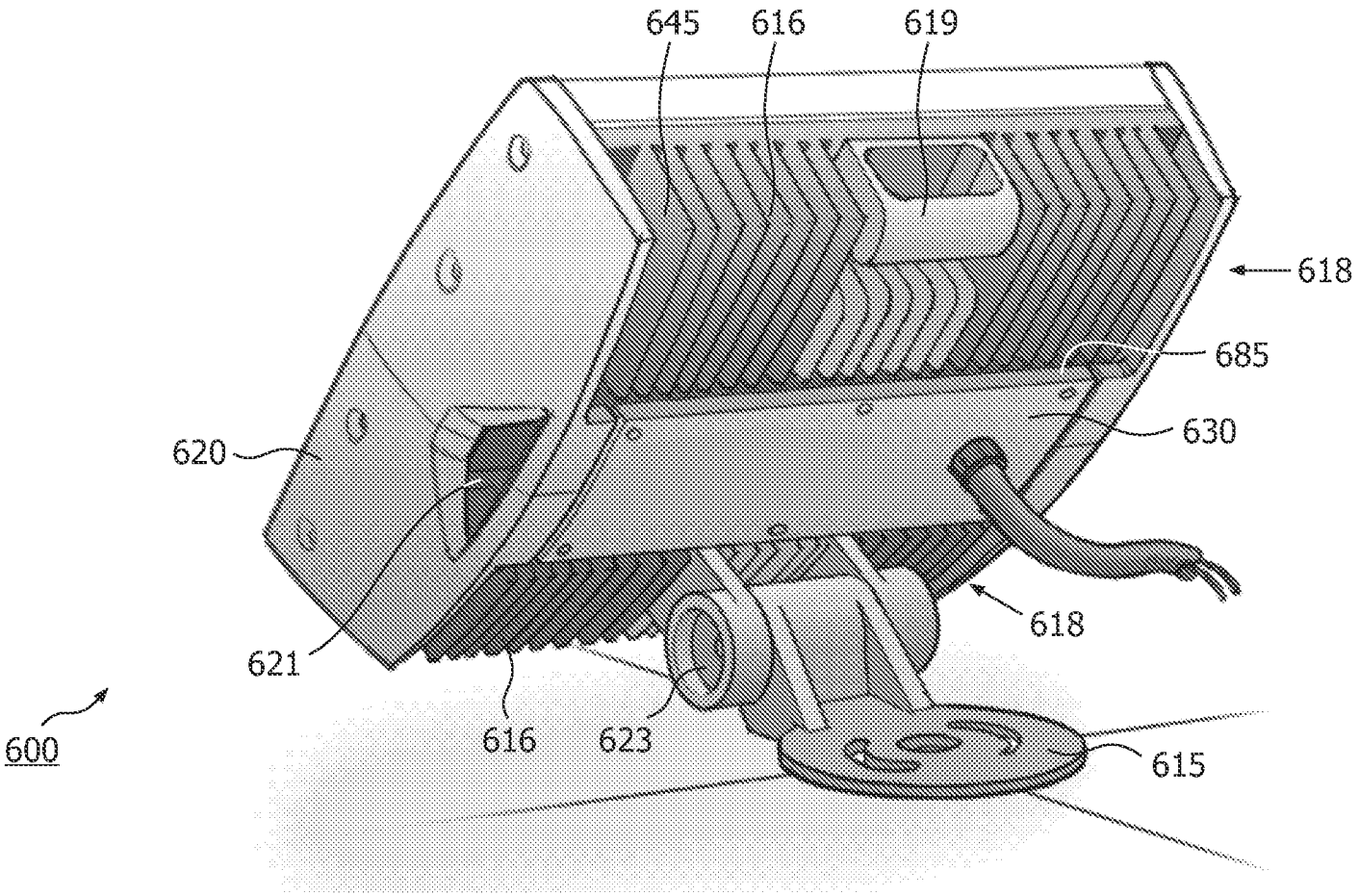
FIG. 7 illustrates an architectural luminaire in accordance with alternative implementations of the present technology.

Referring to FIG. 7, an architectural lighting fixture 600 according to alternative implementations of this disclosure includes a mounting base 615 and a split LED housing 616, comprising two sub-units 618. Sub-units 618 have configurations that differ somewhat from one another. In particular, the sub-unit furthest from the mounting base has a handle/lift hook 619 embedded among a plurality of heat-dissipating fins 645, for manually lifting fixture 600. A pair of supports 620 define holes 621 that provide another entryway (in addition to gaps 685 between the sub-units and a power supply-control circuitry housing 630) for ambient cooling air and may be useful for lifting the lighting fixture, too. The split LED housing is rotatable about a rotation assembly 623 disposed between the mounting base and the heat-dissipating fins of the lower sub-unit 618.

An exterior architectural lighting fixture in accordance with the disclosure has excellent light output and quality useful for large-scale façade washing in exterior architectural applications. The unique design achieves thermal, optical and aesthetic features that result is a superior fixture for efficiently and controllably lighting the largest, most prominent exterior structures.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A lighting system for illuminating a target object disposed within a predetermined range from the lighting system with visible radiation including at least one of first radiation and second radiation, the system comprising:

a first lighting unit and a second lighting unit fixedly disposed within a lighting fixture of the lighting system defining a singular exhaust gap therebetween, at least one of the first lighting unit and the second lighting unit comprising a plurality of first LED light sources generating the first radiation having a first spectrum and a plurality of second LED light sources generating the second radiation having a second spectrum different than the first spectrum;

a first heat dissipating structure thermally connected to a rear surface of the first lighting unit and a second heat dissipating structure thermally connected to a rear surface of the second lighting unit, the first and the second heat dissipating structures configured for dissipating heat generated by the first lighting unit and the second lighting unit, respectively, at least one controller disposed in a controller housing of the lighting fixture and coupled at least to the plurality of first LED light sources and the plurality of second LED light sources and configured to independently control at least a first intensity of the first radiation and a second intensity of the second radiation so as to controllably vary at least an overall perceivable color or color temperature of the visible radiation generated by the lighting system, the controller housing at least partially interposed between the first heat dissipating structure and the second heat dissipating structure and defining a first cool air entry gap between the first heat dissipating structure and the controller housing and a second cool air entry gap between the second heat dissipating structure and the controller housing, the first heat dissipating structure having a plurality of cooling fins directing ambient air substantially transverse to an air flow path of the first cool air entry gap and allowing the directed ambient air around the first heat dissipating structure to one or more of the first cool air entry gap or the exhaust gap;

the second heat dissipating structure having a plurality of cooling fins directing ambient air substantially transverse to an air flow path of the second cool air entry gap and allowing the directed ambient air around the second heat dissipating structure to one or more of the second cool air entry or the exhaust gap, the first cool air entry gap and second cool air entry gap joining to form the exhaust gap and forming an unobstructed path for enabling a flow of ambient air through the lighting fixture, thereby facilitating dissipation of heat generated by the first lighting unit and the second lighting unit.

2. The lighting system of claim 1, further comprising a positioning system for securing the lighting system at an installation site and orienting the lighting system such that the visible radiation is directed towards the target object.

3. The lighting system of claim 1, wherein the first lighting unit and the second lighting unit are disposed within the lighting system such that beams of radiation generated by each of the lighting units substantially converge within a predetermined range.

4. The lighting system of claim 1, wherein the predetermined range is between about 300 feet and about 500 feet.

5. The lighting system of claim 1, wherein each of the first and second lighting units comprises a total of at least 100 LED light sources generating the light output of at least 5000 lumens.

6. The lighting system of claim 1, wherein at least one of the first and second lighting units further comprises a reflector optic secured over at least one first or second LED light source and configured to collimate the radiation emitted by the at least one LED light source into a beam having a beam angle of about 5°.

7. The lighting system of claim 6, wherein the reflector optic comprises:

a bottom portion configured for fastening over the LED light source;

a top portion detachably connected to the bottom portion; and a lens removably secured between the bottom portion and the top portion.

8. The lighting system of claim 7, wherein the bottom portion comprises a bottom surface defining an aperture for receiving the light source when fastened thereover.

9. The lighting system of claim 1, wherein the at least one controller is configured as an addressable controller for receiving at least one network signal including at least first lighting information relating to the overall perceivable color and/or color temperature of the visible radiation generated by the first and second lighting units.

10. The lighting system of claim 1, wherein the second lighting unit comprises at least a plurality of third LED light sources adapted to generate the third radiation having a third spectrum, different from the first and second spectrums.

11. The lighting system of claim 10, wherein the at least one controller is configured to control the LED light sources of the first lighting unit independently of the LED light sources of the second lighting unit.

12. The lighting system of claim 1, wherein both the first lighting unit and second lighting units comprise the plurality of first LED light sources and the plurality of second LED light sources and the at least one controller is configured to control the LED light sources of the first lighting unit simultaneously with and identically to the LED light sources of the second lighting unit.

13. The lighting system of claim 1, wherein the first lighting unit comprises a first lens disposed over the LED light sources therein and the second lighting unit comprises a second lens disposed over the LED light sources therein.

14. The lighting system of claim 13, wherein at least one of the first and second lens is readily replaceable.

15. The lighting system of claim 13, wherein the first and second lens have substantially identical optical properties.

16. The lighting system of claim 13, wherein at least one of the first and second lens comprises a diffusing film disposed thereover.

17. The lighting system of claim 1, wherein the majority of the controller housing is interposed between the first and second heat dissipating structures.

18. A lighting system for illuminating a target object disposed within a predetermined range from the lighting system with visible radiation including at least one of first radiation and second radiation, the system comprising:

a first lighting unit and a second lighting unit fixedly disposed within a lighting fixture defining an exhaust gap therebetween and each of said first lighting unit and said second lighting unit having a lens defining a light output opening for emitting light in a light output direction;

the exhaust gap formed between the first lighting unit and the second lighting unit exhausting heated air in substantially the light output direction;

the first lighting unit having a compartment in which are mounted a plurality of first LEDs generating a first radiation having a first spectrum, the second lighting unit having a compartment in which are mounted a plurality of second LEDs generating the second radiation having a second spectrum different than the first spectrum;

a first heat dissipating structure thermally connected to a rear surface of the first lighting unit and a second heat dissipating structure thermally connected to a rear surface of the second lighting unit, the first and the second heat dissipating structures configured for dissipating heat generated by the first lighting unit and the second lighting unit;

at least one controller disposed in a controller housing of the lighting fixture and coupled at least to the plurality of first LEDs and the plurality of second LEDs, the controller housing at least partially interposed between the first heat dissipating structure and the second heat dissipating structure and defining a first cool air entry gap between the first heat dissipating structure and the controller housing and a second cool air entry gap between the second heat dissipating structure and the controller housing, the first cool air entry gap and second cool air entry gap joining to form the exhaust gap;

the first heat dissipating structure having a plurality of cooling fins directing ambient air transverse to an air flow path of the first cool air entry gap and allowing the directed ambient air around the first heat dissipating structure to one or more of the first cool air entry gap and the exhaust gap;

the second heat dissipating structure having a plurality of cooling fins directing ambient air transverse to an air flow path of the second cool air entry gap and allowing the directed ambient air around the second heat dissipating structure to one or more of the second cool air entry gap and the exhaust gap.

19. A lighting system for illuminating a target object disposed within a predetermined range from the lighting system with visible radiation including at least one of first radiation and second radiation, the system comprising:

a first lighting unit integrated with a second lighting unit, each of the first and second lighting unit having a compartment with a plurality of densely packed LEDs, the plurality of LEDs of the first lighting unit emitting cumulative light of the first radiation, the plurality of LEDs of the second lighting unit emitting cumulative light of the second radiation;

a controller operably connected to the plurality of LEDs of the first and second lighting unit, the controller housed in a controller housing;

each of the first and second lighting unit further having a section having a rear section with a plurality of heat dissipating fins;

the first lighting unit and the second lighting unit forming a space which receives the controller housing thereby forming a first inlet air gap between the controller housing and the first lighting unit and a second inlet air gap between the controller housing and the second lighting unit;

the first lighting unit combined with the second lighting unit forming an exhaust gap in fluid communication with the first inlet air gap and the second inlet air gap, both the first inlet air gap and the second inlet air gap adjacent the controller housing;

the heat dissipating fins of the first lighting unit directing ambient air from a first side of the lighting system and transverse to the exhaust gap;

the heat dissipating fins of the second lighting unit directing ambient air from a second side of the lighting system and transverse to the exhaust gap, the second side of the lighting system opposite the first side;

the exhaust gap drawing ambient air in a first direction through lighting system by the first inlet air gap and the second inlet air gap and drawing ambient air in a second direction through the heat dissipating fins of the first lighting unit and a third direction through the heat dissipating fins of the second lighting unit, the first direction substantially being in a light output direction of the lighting system, the second direction and the third direction being opposing directions and being substantially transverse to the first direction.

* * * * *